US009212570B2

(12) United States Patent
Manther et al.

(10) Patent No.: US 9,212,570 B2
(45) Date of Patent: Dec. 15, 2015

(54) NESTED LOCKING MECHANISM FOR SWITCHABLE ROLLER FINGER FOLLOWER

(71) Applicant: Schaeffler Technologies AG & Co. KG, Herzogenaurach (DE)

(72) Inventors: Debora Manther, Royal Oak, MI (US); Jeff Villemure, Beverly Hills, MI (US); Jeffrey Shewell, Clawson, MI (US); Kirk Siefker, Pleasant Ridge, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 13/837,382

(22) Filed: Mar. 15, 2013

(65) Prior Publication Data

US 2013/0284136 A1 Oct. 31, 2013

Related U.S. Application Data

(60) Provisional application No. 61/638,297, filed on Apr. 25, 2012, provisional application No. 61/638,300, filed on Apr. 25, 2012, provisional application No. 61/638,302, filed on Apr. 25, 2012.

(51) Int. Cl.
*F01L 1/18* (2006.01)
*F01L 13/00* (2006.01)

(52) U.S. Cl.
CPC ..... *F01L 1/181* (2013.01); *F01L 1/182* (2013.01); *F01L 1/185* (2013.01); *F01L 13/0005* (2013.01); *F01L 13/0036* (2013.01); *F01L 2001/186* (2013.01)

(58) Field of Classification Search
CPC ..... F01L 1/181; F01L 1/182; F01L 2001/186
USPC ..... 123/90.39, 90.44
See application file for complete search history.

(56) References Cited

U.S. PATENT DOCUMENTS

| | | | | |
|---|---|---|---|---|
| 8,267,059 | B2 | 9/2012 | Manther et al. | |
| 2010/0300389 | A1 | 12/2010 | Manther et al. | 123/90.39 |
| 2011/0197842 | A1 | 8/2011 | Manther et al. | 123/90.44 |

FOREIGN PATENT DOCUMENTS

DE 10310968 A1 9/2004

OTHER PUBLICATIONS

Manther et al., Switchable Finger Lever, US Patent Application Publication Pub. No. US 2010/0300389, Dec. 2, 2010.*

(Continued)

*Primary Examiner* — Ching Chang
(74) *Attorney, Agent, or Firm* — Fitzpatrick, Cella, Harper & Scinto

(57) ABSTRACT

A finger lever is provided for a valve train of an internal combustion engine. The finger lever comprises an inner lever, at least one arm pivotally coupled to the inner lever, and a coupling device operatively displaceable to control movement of the at least one arm relative to the inner lever. The coupling device includes a slide and a piston disposed in a longitudinal bore of the inner lever, the piston having an entraining slot in which at least part of the slide is received, and at least one biasing member arranged to bias the piston relative to the inner lever. The slide is constructed to be displaced in a coupled position or an uncoupled position. In the coupled position the slide is entrained by the at least one arm, and in the uncoupled position the slide is not entrained by the at least one arm.

26 Claims, 17 Drawing Sheets

(56) References Cited

OTHER PUBLICATIONS

Kirbach, Switchable Roller Finger Follower, US Patent Application Publication Pub. No. US 2011/0126787, Jun. 2, 2011.*
Office Action issued in connection with U.S. Appl. No. 13/837,512 on May 14, 2014.
Office Action issued in connection with U.S. Appl. No. 13/837,320 on May 14, 2014.
U.S. Appl. No. 13/837,320, filed Mar. 15, 2013, First Named Inventor: Debora Manther.
U.S. Appl. No. 13/837,512, filed Mar. 15, 2013, First Named Inventor: Debora Manther.

* cited by examiner

NESTED LOCKING MECHANISM FOR SWITCHABLE ROLLER FINGER FOLLOWER

CROSS REFERENCE TO RELATED APPLICATIONS

This application claims the benefit under 35 U.S.C. 119(e) of U.S. Provisional Patent Application Nos. 61/638,297, 61/638,300 and 61/638,302, each filed on Apr. 25, 2012. Each of those provisional applications is incorporated by reference herein in its entirety, as if set forth fully herein.

BACKGROUND

1. Field

Example aspects herein relate to a locking feature for a switchable finger lever for a valve train of an internal combustion engine and, in particular, to a locking feature for a switchable finger lever.

2. Description of the Related Art

Switchable finger levers are described in DE 103 10 968 A1 and in U.S. patent application Ser. No. 12/800,151 (Manther et al.). In Manther, a coupling slide 13 is employed to operatively lock and unlock finger lever 1. The coupling slide 13 is axially retained by retaining elements 39, which are assembled with the lever 1.

SUMMARY

According to one example aspect herein, a finger lever for a valve train of an internal combustion engine is provided. The finger lever comprises an inner lever, at least one arm pivotally coupled to the inner lever, and a coupling device operatively displaceable to control movement of the at least one arm relative to the inner lever.

In one example embodiment, the finger lever includes at least one urging member arranged to urge movement of the at least one arm relative to the inner lever. Also, the coupling device may comprise a slide, which may be disposed in at least one hole formed in the inner lever.

The coupling device may further comprise a piston disposed in a longitudinal bore of the inner lever. The piston has an entraining slot in which at least part of the slide is received. The coupling device may also further comprise at least one biasing member arranged to bias the piston relative to the inner lever. In one embodiment, the slide is constructed to be displaced in a coupled position or an uncoupled position, wherein in the coupled position the slide is entrained by the at least one arm, and in the uncoupled position the slide is not entrained by the at least one arm. When the slide is in the coupled position, the at least one arm is not permitted to pivot relative to the inner lever, and in the uncoupled position, the at least one arm is permitted to pivot relative to the inner lever.

In one example embodiment the slide extends through at least one outer wall of the inner lever in a first direction transverse to the longitudinal bore.

The slide may also be restrained from movement in the first direction by a retainer interposed between the slide and the inner lever, and wherein the retainer is positioned within the inner lever. A first annular groove may be formed in the slide and the retainer extends from the inner lever into the first annular groove.

A second annular groove may also be formed in the piston, and the retainer may be formed as an annular retaining element which is seated between the first and the second annular grooves when the first and the second annular grooves are in alignment.

In another example embodiment, the slide has a groove formed on its outer periphery. The groove may have side walls spaced apart to be received around the entraining slot of the piston. The slide that is received in the slot of the piston may be guided in the inner lever by at least one side wall of the slot. The groove formed in the slide may be an annular groove surrounding the periphery of the slide and the groove may also be formed as a flat notch.

This brief summary has been provided so that the nature of the invention may be understood quickly. A more complete understanding of the invention can be obtained by reference to the following detailed description in connection with the attached drawings.

BRIEF DESCRIPTION OF THE DRAWINGS

The invention is described below with reference to the appended drawings.

DETAILED DESCRIPTION OF THE DRAWINGS

At the outset, it should be appreciated that like drawing numbers appearing in different drawing views identify identical, or functionally similar, structural elements. Furthermore, it is understood that this invention is not limited only to the particular embodiments, methodology, materials and modifications described herein, and as such may, of course, vary. It is also understood that the terminology used herein is for the purpose of describing particular aspects only, and is not intended to limit the scope of the present invention.

A switchable finger lever is described in U.S. patent application Ser. No. 12/800,151, the entire contents of which are incorporated herein by reference, as if set forth fully herein. That application describes the following embodiment, now described with reference to FIGS. 1, 2A, and 3, labeled PRIOR ART.

Figure 1:
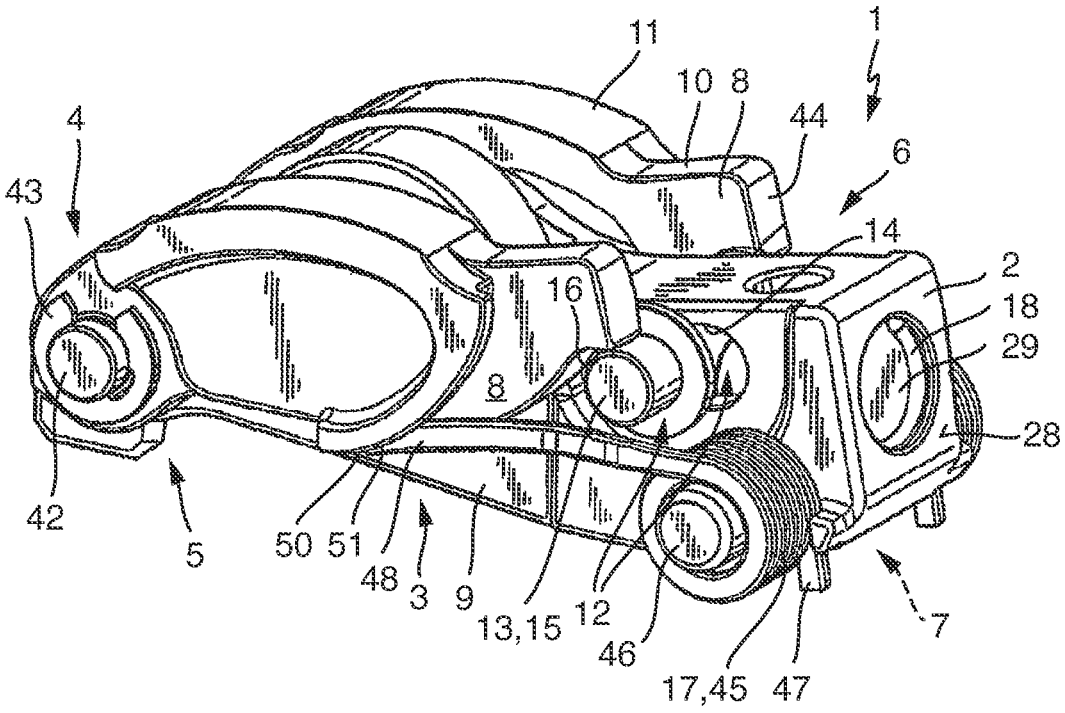
Fig. 1 PRIOR ART
FIG. 1 shows an isometric view of a prior art embodiment of a finger lever, as viewed looking towards a side and end thereof.
Figure 2A:
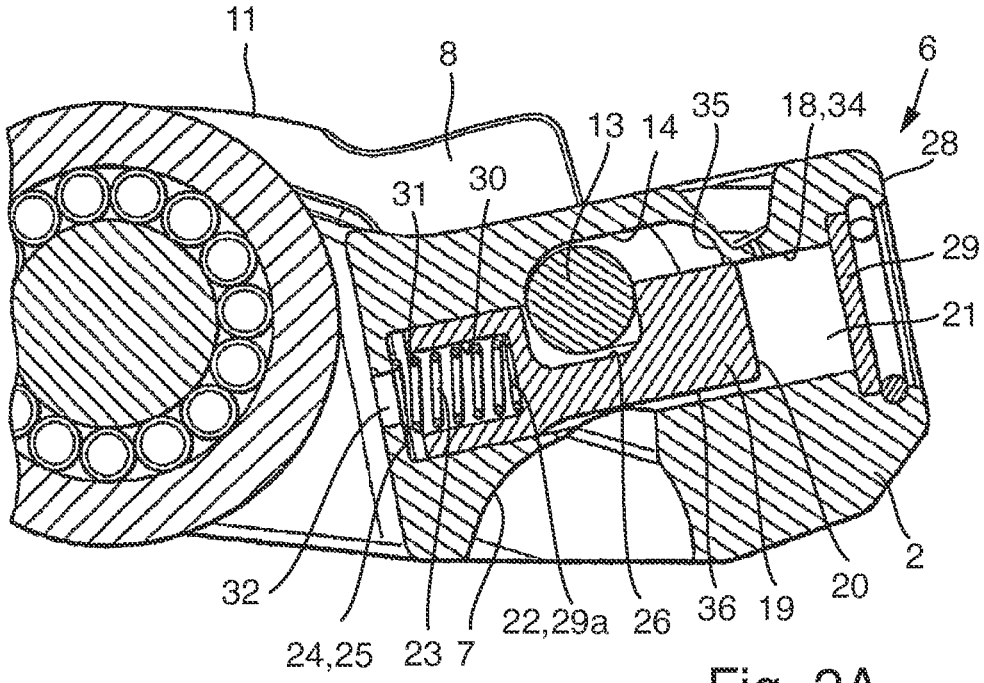
Fig. 2A PRIOR ART
FIG. 2A shows a longitudinal section through the finger lever of FIG. 1 in a region of its coupling device.
Figure 3:
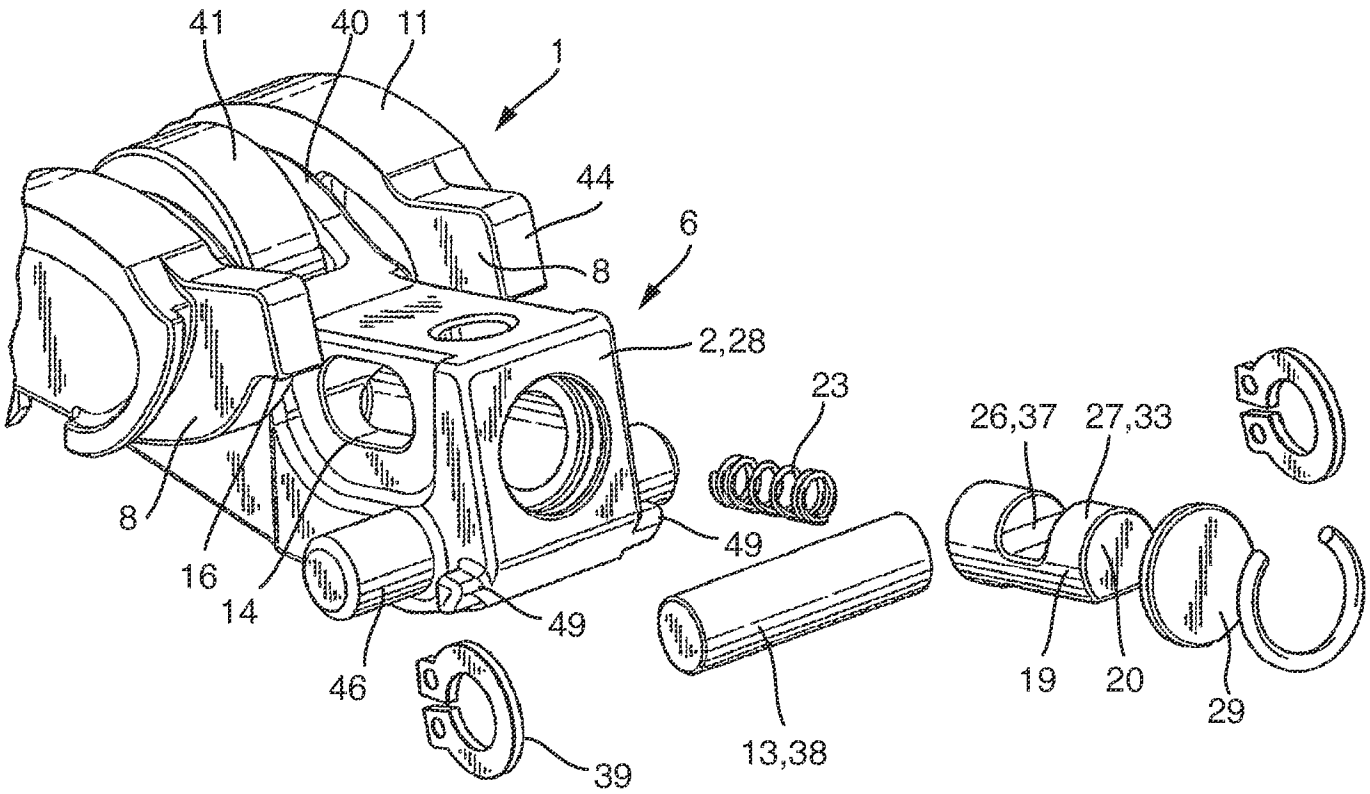
Fig. 3 PRIOR ART
FIG. 3 shows the finger lever of FIG. 1 with its main components, in an exploded representation, as viewed from a perspective looking towards a side and end thereof.

An embodiment of a switchable finger lever 1 is shown in FIG. 1 and is configured as a lift alteration switch, and parts of lever 1 also are shown in FIGS. 2A and 3. Finger lever 1 comprises an elongate inner lever 2 which comprises on an underside 3 at one end 4, a support 5 for an associated gas exchange valve (not illustrated). At another end 6, inner lever 2 comprises, on the underside 3, a contact surface 7 configured in one example as a semi-spherical or curved cavity for a pivotal mounting of a head of a support element (not illustrated).

At least two axle stubs 42 protrude from outer walls 9 of inner lever 2 in the region of end 4. An outer arm 8 is secured to each axle stub 42. Outer arms 8 are fixed or otherwise coupled on the axle stubs 42 through appropriate anti-loss devices 43, such as bent snap rings or another suitable coupling mechanism.

In the illustrated example, outer arms 8 do not extend an entire length of inner lever 2 but end with their front ends 44 (FIGS. 1 and 3) in front of or adjacent a coupling device 12 to be described later. Upper sides 10 of outer arms 8 can be slightly cylindrically arched and form contacting surfaces 11 for high lift cams (not illustrated). Inner lever 2 extends substantially longitudinally and contacting surfaces 11 extend outwardly in a direction transverse to the longitudinal direction of inner lever 2.

In the region of front ends 44 (FIGS. 1 and 3), each outer arm 8 comprises an entraining surface 16 for a coupling slide 13 of coupling device 12. FIGS. 1 and 2A depict a coupled state of coupling device 12 in which slide 13 is coupled to outer arms 8, so that a lift of high lift cams (not illustrated) in contact with outer arms 8 is transmitted to an associated gas exchange valve (not illustrated).

Coupling device 12 comprises a longitudinal bore 18 starting from a front end surface 28 on end 6 of inner lever 2, and an entraining piston 19 (FIGS. 2A and 3) received for longitudinal displacement in longitudinal bore 18. Entraining piston 19 defines, with its front end 20 (FIGS. 2A and 3) situated on the side of end 6, a pressure chamber 21 (FIG. 2A) for a hydraulic medium. Axially outwards, pressure chamber 21 is closed by a plug 29. A supply of hydraulic medium into pressure chamber 21 for realizing a coupled position of coupling device 12 is affected through a longitudinal channel 36 (FIG. 2A) at an underside of entraining piston 19.

A displacement of entraining piston 19 into an uncoupled position, i.e. in direction of end 6, is realized through the force of a compression spring 23 (FIGS. 2A and 3) (alternatively also through hydraulic medium). Compression spring 23 is supported at one end disposed against a surface 29*a* (FIG. 2A) of another end 22 (FIG. 2A) of entraining piston 19. Another end of compression spring 23 acts against a surface 31 (FIG. 2A) adjacent to a lower end of longitudinal bore 18. In this region is also provided a ventilating aperture 32 (FIG. 2A), so that no undesired compression of air takes place upon a corresponding displacement of entraining piston 19.

An upper side 33 (FIG. 3) of entraining piston 19 (FIG. 3) comprises a crosswise extending incision 26 (FIG. 3) in which can be seated, while being supported on side walls 37 of incision 26, coupling slide 13. Coupling slide 13 protrudes (FIG. 1) beyond outer walls 9 of inner lever 2 and is longitudinally displaceable in oblong holes 14. An axial fixing of coupling slide 13 is realized through retaining elements 39 which, in the example shown in FIG. 3, are configured as snap rings with frictional locking, so that annular grooves in coupling slide 13 can be dispensed with.

As shown in FIG. 1, adjacent contact surface 7 on end 6 are arranged two further protruding axle stubs 46. A restoring spring 17, configured as a torsion leg spring, extends with its coil assembly 45 on each axle stub 46. A first leg 47 of restoring spring 17 bears against a stop 49 of inner lever 2. A second leg 48 extends towards end 4 and bears against a support 50 on an underside of corresponding outer arm 8. Flanks of second legs 48, mesh in contact region 51 with support 50 of respective outer arm 8, in similar manner to involute gearwheel teeth that mesh with each other, so that relatively low friction can be expected in contact region 51. In another embodiment, contact region 51 and second leg 48 are arranged to be convex, and more specifically, may be an involute, such that region 51 and second leg 48 do not interfere with each other. Where contact region 51 and second leg 48 are involutes, contact therebetween is a rolling contact, not a sliding contact.

To obtain the coupled state of coupling device 12 shown in FIG. 1, pressure chamber 21 (FIG. 2A) is pressurized during the cam base circle phase by hydraulic medium out of contact surface 7 (FIG. 2A) supplied via longitudinal channel 36 (FIG. 2A). Entraining piston 19 is displaced against the force of its compression spring 23 towards end 4. During this displacement, entraining piston 19 entrains coupling slide 13 with which it is connected. When coupling slide 13 has reached its fully displaced position (FIG. 1), it engages entraining surfaces 16 of outer arms 8 through both of its end portions 15 with slight coupling lash under entraining surfaces 16 of outer arms 8. In the coupled state, during a subsequent cam lift, finger lever 1 follows the lift of the high lift cams (not illustrated).

To obtain a low valve lift on the gas exchange valve (not illustrated), the hydraulic medium pressure in pressure chamber 21 is substantially reduced during the cam base circle phase, so that entraining piston 19, together with its coupling slide 13, are displaced towards end 6 through the force of compression spring 23. During this displacement, both end portions 15 of coupling slide 13 come out of contact with outer arms 8. During a subsequent cam lift, outer arms 8 pivot "in idle" against force of torsional lost motion/restoring spring arms 48. Outer arms 8 pivot "in idle" about axle stubs 42 relative to inner lever 2, so that inner lever 2 executes a pivoting movement in accordance with its activating low lift cam. Finger lever 1 relies on retaining elements 39 to axially retain coupling slide 13.

Figure 2B:
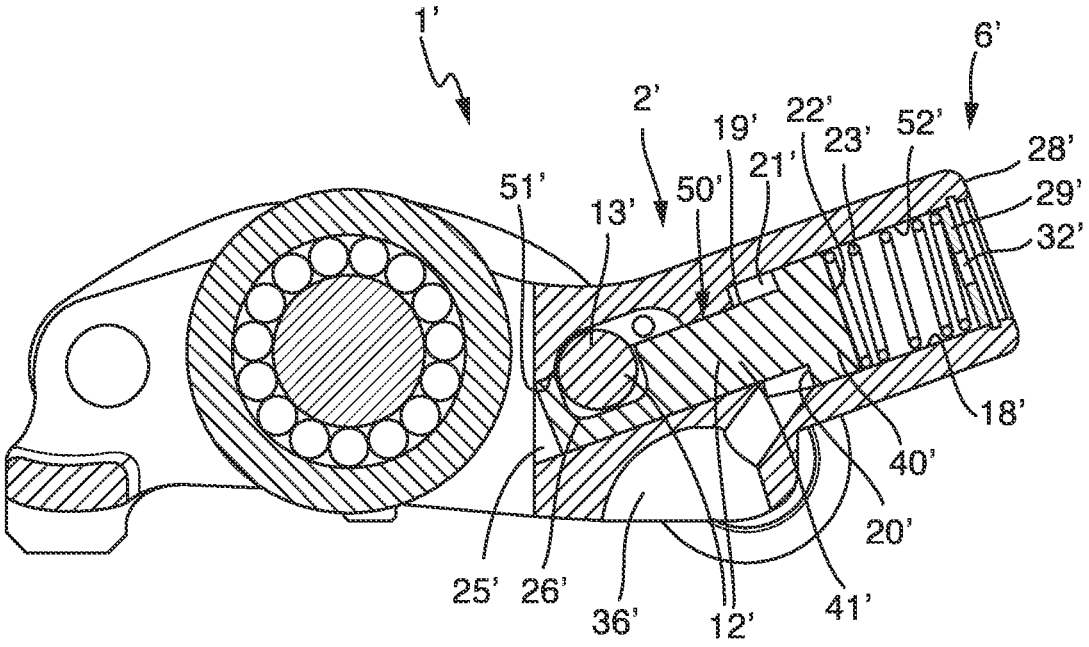
FIG. 2B shows a longitudinal section through a finger lever in a region of its coupling device, according to an example aspect of the present application.

FIG. 2B shows a longitudinal section through an alternate embodiment of a finger lever 1' in a region of its coupling device 12', according to an example aspect of the present application. Finger lever 1' is constructed similarly to finger lever 1, but differs with respect to the following features of its inner lever 2' and coupling device 12'.

Coupling device 12' has a longitudinal bore 18' formed therein that extends from a front end surface 28' at end 6' of inner lever 2' to an inner end 25'. Coupling device 12' comprises an entraining piston 19' received in bore 18' for longitudinal displacement therein. Piston 19' is comprised of a piston head 40' and a stem 41'. Piston head 40' is proximate to end 6' while stem 41' is proximate to inner end 25'. A coupling slide 13' is positioned in an incision 26' formed transversely in entraining piston 19'. Bore 18' has a stepped internal surface 50' having a first diameter 51' to slidably receive piston head 40' while bore 18' has a second diameter 52' to slidably receive stem 41'. A pressure chamber 21' is defined between bore 18' and piston 19'. A compression spring 23' is disposed in bore 18' between a front face 22' of entraining piston 19' and a plug 29', which is retained in bore 18' at end 6'. A ventilation aperture 32' is formed in plug 29' so that no undesired compression of air takes place upon a corresponding displacement of entraining piston 19' in bore 18'. Coupling slide 13' and entraining piston 19' are shown in a locked state where force from compression spring biases entraining piston 19' toward inner end 25' of bore 18' such that coupling slide 13' is positioned to be retained by arms 8 (FIG. 1).

Introduction of hydraulic medium into pressure chamber 21', for realizing an uncoupled state of coupling device 12' is affected through a longitudinal channel 36' at an underside of entraining piston 19'. That is, a displacement of entraining piston 19' into an uncoupled position, i.e. in direction of end 6', is realized through the introduction of hydraulic medium into pressure chamber 21' via channel 36'. Fluid acting on entraining piston 19' at annular rear face 20' urges piston 19' toward end 6' against spring 23', which becomes compressed. During this displacement, entraining piston 19' entrains coupling slide 13' with which it is connected. The entrained coupling slide 13' is displaced in bore 18' toward end 6' so that coupling slide 13' is dislodged from under arms 8 (FIG. 1).

Accordingly, the embodiment of the finger lever 1' differs operationally from finger lever 1 in that finger lever 1' can achieve the locked state of its coupling device 12' without pressurizing pressure chamber 21', whereas finger lever 1 achieves the locked state of its coupling device 12 by pressurizing pressure chamber 20.

Example embodiments herein will now be described, which improve upon the above embodiments. Each of the following example embodiments of a finger lever employ a different axial retention arrangement than described above for finger lever 1.

Figure 4:
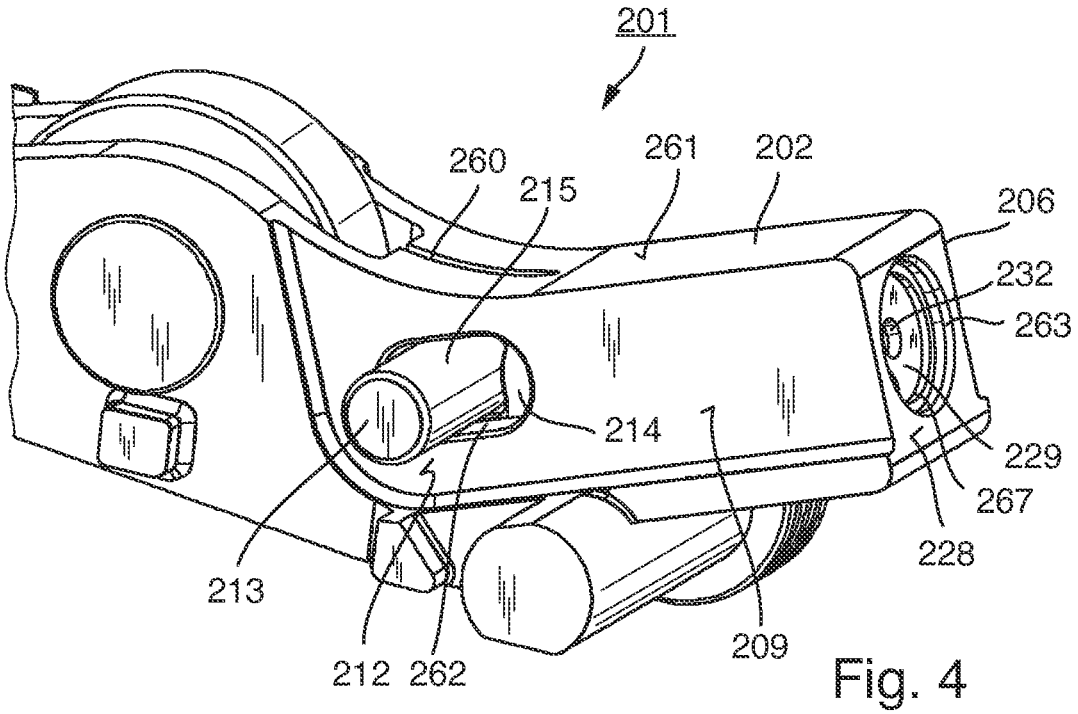
FIG. 4 shows an isometric view of a finger lever according to an example aspect herein, as viewed from a perspective looking towards a side and an end thereof.

An example of an embodiment of a finger lever 201, according to an example aspect herein, is partially shown in FIG. 4, and is also at least partly represented in FIGS. 7-10. Unless noted hereinbelow, all parts of finger lever 201 are the same as those of finger lever 1, described above. Though omitted for clarity of illustration in FIG. 4, finger lever 201 also comprises outer arms 8 and restoring spring 17 like finger lever 1. Thus, it will be understood by those of ordinary skill in the art that FIG. 4 shows an inner lever 202 and a coupling device 212, corresponding to inner lever 2 and coupling device 12, respectively, of finger lever 1, and also includes outer arms 8 (not shown, for convenience).

Figure 8:
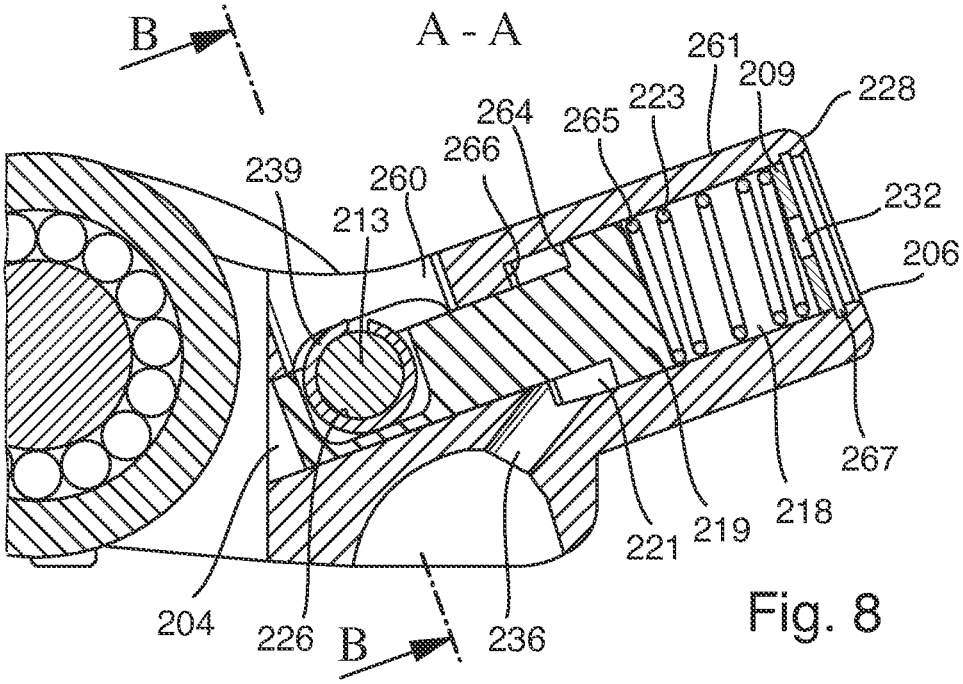
FIG. 8 is a section view of the finger lever of FIG. 4, taken along section line A-A of FIG. 7.

Inner lever 202 extends in a longitudinal direction and has a through slot 260 formed along an upper surface 261 of inner lever 202. Referring also to FIG. 8, through slot 260 extends from upper surface 261 through inner lever 201 to a coupling slide 213. Slot 260 is dimensioned to permit a retaining ring 239 (FIGS. 5, 8, 9 and 10) to be inserted through slot 260, so as to encircle coupling slide 213, as described hereinbelow.

Figure 9:
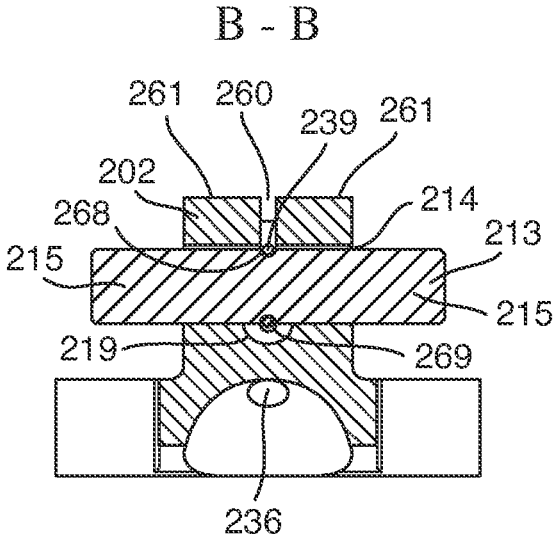
FIG. 9 is a section view of the finger lever of FIG. 4, taken along section line B-B of FIG. 8.
Figure 10:
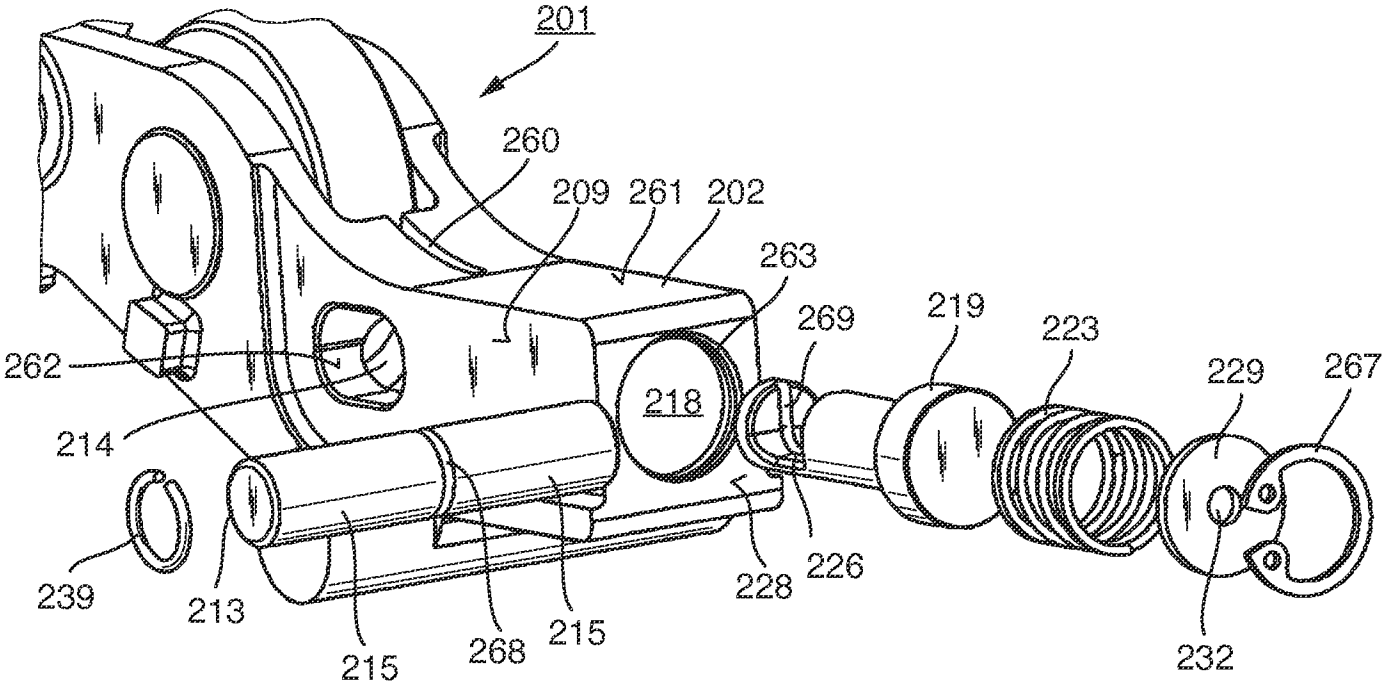
FIG. 10 shows the finger lever of FIG. 4 with its main components, in an exploded representation.
Figure 11:
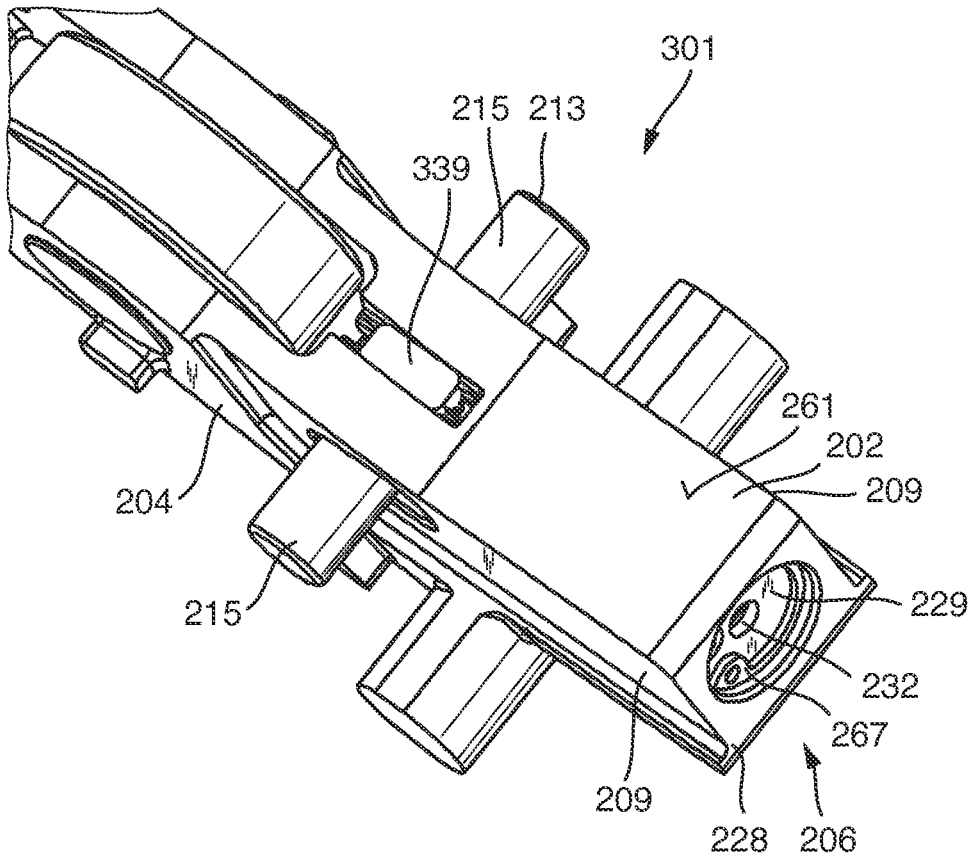
FIG. 11 shows an isometric view of an alternate embodiment of a finger lever, according to an example aspect herein, as viewed from a perspective looking down on an upper part, sides, and an end thereof.
Figure 12:
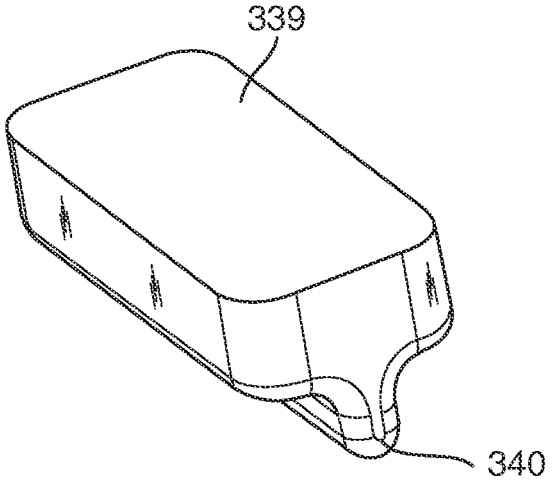
FIG. 12 shows a retention member which is included with the finger lever of FIG. 11.

Inner lever 202 has aligned oblong holes 214, shown in FIGS. 4 and 10, formed in opposite outer walls 209 of inner lever 202. Coupling slide 213 extends through both oblong holes 214 and extends transverse to inner lever 202. Coupling slide 213 is supported by surfaces 262 (FIGS. 4 and 10) of inner lever 202 that define oblong holes 214. Coupling slide 213 is constructed to roll on surfaces 262 in oblong holes 214 when coupling slide 213 is displaced, as described hereinbelow. FIG. 4 shows coupling device 212 in a coupled state, so that a lift of the high lift cams (not illustrated) in contact with outer arms 8 (not shown in FIGS. 4-10, as discussed above, but shown in FIG. 1) can be transmitted to gas exchange valve (not illustrated).

Figure 7:
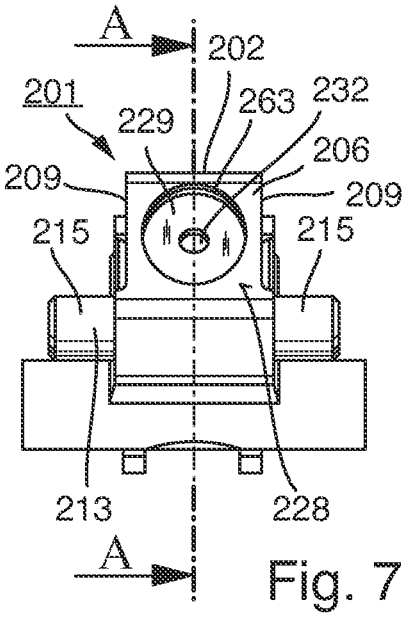
FIG. 7 shows an elevation view of the finger lever of FIG. 4 as seen from a perspective looking towards the end.

FIG. 7 shows an elevation view of finger lever 201 of FIG. 4 as viewed from a perspective looking toward an outer end 206 of inner lever 202. End portions 215 of coupling slide 213 protrude axially outwardly from outer walls 209 of inner lever 201. Also shown in FIG. 7 is an opening 263 formed in outer end 206 which leads to a longitudinal bore 218, shown in greater detail in FIG. 8. Surrounding opening 263 is an end surface 228. Opening 263 can be at least partially closed by plug 229 which has an aperture 232 formed therein. Aperture 232 permits gas exchange therethrough. Plug 229 is retained in inner lever 202 proximate outer end 206 by a snap ring 267 (See, FIGS. 4, 8, and 10).

FIG. 8 shows a view of finger lever 201 taken along section line A-A in FIG. 7. The aforementioned longitudinal bore 218 extends from end surface 228 at outer end 206 shown in FIG. 8 to an inner end 204. An entraining piston 219 is received in longitudinal bore 218 for longitudinal displacement. Entraining piston 219 is biased by a spring 223 which urges entraining piston 219 towards inner end 204. A pressure chamber 221 is defined between a back side 264 of a face 265 of entraining piston 219 and a flange 266 formed in bore 219. Inner end 204 of bore 218 is closed.

Figure 5:
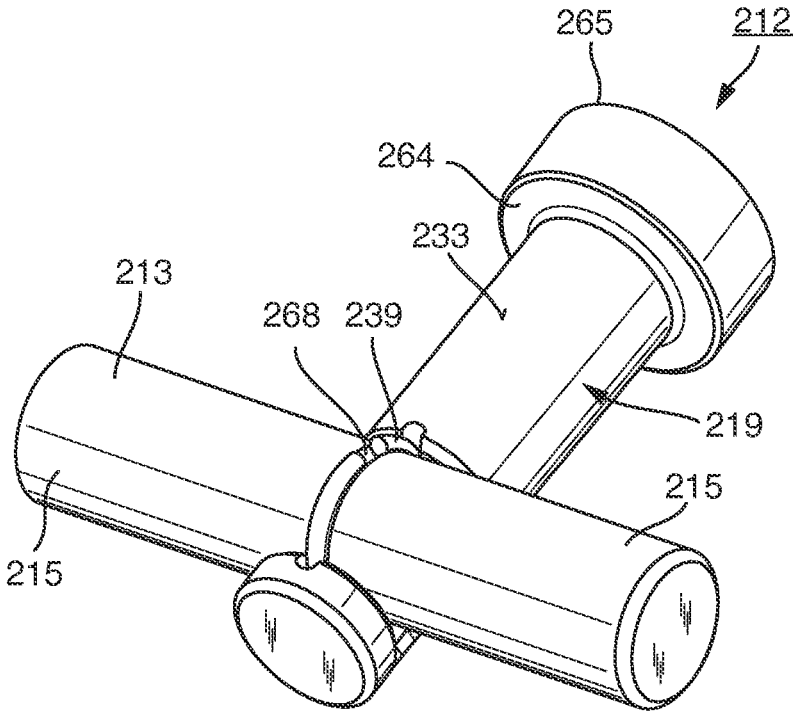
FIG. 5 shows an isometric view of an arrangement of a coupling slide and an entraining piston of the finger lever of FIG. 4.
Figure 6:
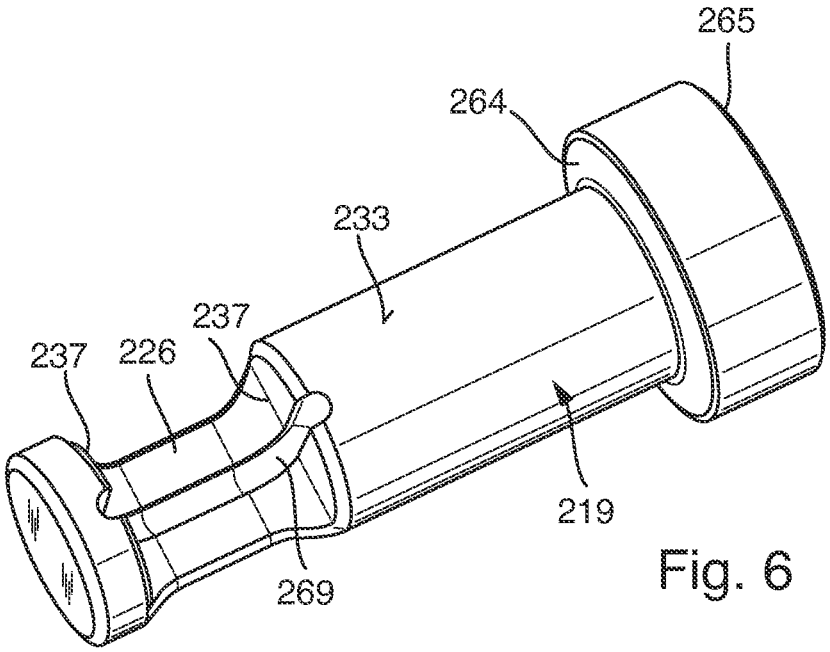
FIG. 6 shows an isometric view of the entraining piston of FIG. 5.

A description of coupling slide 213 and entraining piston 219 will now be provided with reference to FIGS. 5, 6, and 9.

An upper side 233 (FIGS. 5 and 6) of entraining piston 219 has, in a part thereof, a crosswise extending incision 226 (FIG. 6) forming side walls 237. As shown in FIG. 5, coupling slide 213 is seated in incision 226 while being supported by at least one of side walls 237.

Coupling slide 213 is axially retained in oblong holes 214 through a coupling between coupling slide 213 and entraining piston 219 caused by the introduction of a retaining element 239 therebetween. As illustrated in the embodiment shown in FIGS. 5 and 9, retaining element 239 is constructed generally as a ring which is seated in an annular groove centrally formed around coupling slide 213. Ring 239 is discontinuous to permit it to be assembled onto coupling slide 213. The outer surface of ring 239 is received in a groove 269 formed in incision 226. The cross section of groove 269 formed in incision 226 (FIG. 9) is complementary to the cross section of ring 239.

As shown in FIG. 9, ring 239 and annular grooves 268 and 269 are aligned with slot 260 formed in upper surface 261 of inner lever 202. This alignment facilitates assembly of coupling slide 213, entraining piston 219, and ring 239 in inner lever 202. During assembly, grooves 268 and 269 are longitudinally aligned within bore 218 (FIG. 8) and are also aligned with through slot 260. Then ring 239 is introduced through through slot 260 and snapped around coupling slide 213 in annular groove 268, while simultaneously seating ring 239 into groove 269, formed in incision 226. When assembled together as shown in FIG. 5, coupling slide 213 is axially retained with respect to entraining piston 219 by ring 239. Moreover, when coupling slide 213 is assembled into inner lever 202, rotation of coupling slide 213 is substantially not limited. One benefit of the arrangement between coupling slide 213 and entraining piston 219 is that the arrangement of externally assembled snap rings 39 of finger lever 1 can be dispensed with.

A hydraulic medium can be introduced into pressure chamber 221 through a longitudinal channel 236 (FIG. 8) located adjacent an underside of entraining piston 219. Such hydraulic medium is operatively introduced or removed from pressure chamber 221 to longitudinally displace coupling slide 213 in the oblong hole 214. For example, as discussed above, FIG. 4 (and also FIG. 8) shows coupling slide 213 and coupling device 212 in a coupled state with ends 215 of coupling slide 213 at an end of the oblong hole closest to end 204. When hydraulic medium is operatively introduced into pressure chamber 221, hydraulic medium acts on entraining piston 219 to move towards end 206, which also moves coupling slide 213 toward end 206 to place coupling device 212 in a decoupled state. Also, hydraulic medium is operatively permitted to be released from pressure chamber 221 to allow coupling device 212 to return to the coupled state, as described hereinbelow.

A displacement of entraining piston 219 into a coupled position, i.e. in a direction toward inner end 204, is realized through the urging force of compression spring 223 acting between entraining piston 219 and plug 229. It will be appreciated by those of ordinary skill in the art in view of this description that the arrangement of entraining piston 219 and spring 223 can be longitudinally reversed, similar to the arrangement shown in FIG. 3, such that a displacement of entraining piston 219 into a coupled position would be realized through introduction of hydraulic medium to apply force to compress compression spring 223 toward inner end 204. Aperture 232 is formed so that no undesired compression of air takes place upon a corresponding displacement of entraining piston 219.

To obtain a low valve lift on the gas exchange valve, hydraulic medium pressure in pressure chamber 221 is increased to obtain the uncoupled state of coupling device 212. During the cam base circle phase pressure chamber 221 is pressurized by hydraulic medium supplied via longitudinal channel 236. Entraining piston 219 is displaced against the force of its compression spring 223 towards outer end 206. During this displacement, entraining piston 219 entrains coupling slide 213 with which it is operatively coupled. During this displacement, end portions 215 of coupling slide 213 come out of contact from outer arms 8 (not shows in FIGS. 4-10, as explained above, but shown in FIG. 1). During a subsequent cam lift, outer arms 8 (not shown in FIGS. 4-10, as discussed above, but shown in FIG. 1) pivot "in idle" relative to inner lever 202, so that inner lever 202 executes a pivoting movement in accordance with its activating low lift cam.

To obtain a high valve lift on the gas exchange valve, the hydraulic medium pressure in pressure chamber 221 is substantially reduced during the cam base circle phase, so that entraining piston 219 together with coupling slide 213 are displaced towards inner end 204 (FIG. 8) through the force of compression spring 223. When coupling slide 213 has reached its final position, it engages through its end portions 215 with slight coupling lash under entraining surfaces 16 (not shown in FIGS. 4-10, as discussed above, but shown in FIG. 1) of outer arms 8 (not shown in FIGS. 4-10, as discussed above, but shown in FIG. 1). In the coupled state, during a subsequent cam lift, finger lever 201 follows the lift of the high lift cams.

Another example embodiment of a finger lever 301 will now be described with reference to FIGS. 11 to 13A. Finger lever 301 is substantially the same as finger lever 201, except that finger lever 301 employs a different arrangement for axially retaining coupling slide 213. More specifically, finger lever 301 includes a coupling device 312, which includes an entraining piston 319 (FIG. 13A) and coupling slide 213. Entraining piston 319 is similar to entraining piston 219, except that entraining piston 319 does not include a groove formed in an incision 326. Instead, coupling slide 213 is axially retained by a stop 339, which is retained in slot 260. Stop 339 includes an edge 340, shown in FIG. 12, that extends into annular groove 268 (FIG. 13A) formed in coupling slide 213. As will be appreciated by those of ordinary skill in the art in view of the description, stop 339 can be retained in slot 260 by various arrangements, including, for example, one or more of a snap feature, a sliding feature into a slot formed in the inner lever, a weld, a material deformation, and an interference fit, and/or the like.

It will be appreciated that slot 260 formed in inner lever 202 may have different configurations than as represented in the drawings, and may be based upon the configuration of stop 339, which may also differ from that depicted. Thus, the invention should not be limited to only the specific configurations shown in FIGS. 11 to 13A, which should be understood to be exemplary in nature.

Coupling device 312 (FIG. 13A) operates in the same manner as described above for coupling device 212, and thus a further description of that operation is omitted for the sake of brevity.

An alternate arrangement of finger lever 301 and coupling device 312 will now be described with reference to FIGS. 13B and 13C. An inner lever 202' has a bore 218' formed therein which is sealed at end with a plug 229'. An inner facing side 230' of plug 239' has at least one annular channel 231' formed therein. A piston 319' is disposed in bore 218', having a head 340' disposed toward the plug 229' and a stem 341' disposed toward an inner end 204' of the bore. Piston 319' is constructed to slide longitudinally within bore 218'. Bore 218' has a first diameter 351' constructed to slidably receive head 340' of piston 319'. Bore 218' also has a second diameter 352' constructed to slidably receive stem 341' of piston 319'. A compression spring surrounds stem 341' in an annular space defined between the stem 341' of entraining piston 319' and bore 218'. Spring 223' biases piston 319' toward plug 229'. Translation of entraining piston 319' toward inner end 204' of bore 218' compresses spring 223' and thereby produces an oppositely directed spring force on piston 319' toward the plug 229'.

Figure 13A:
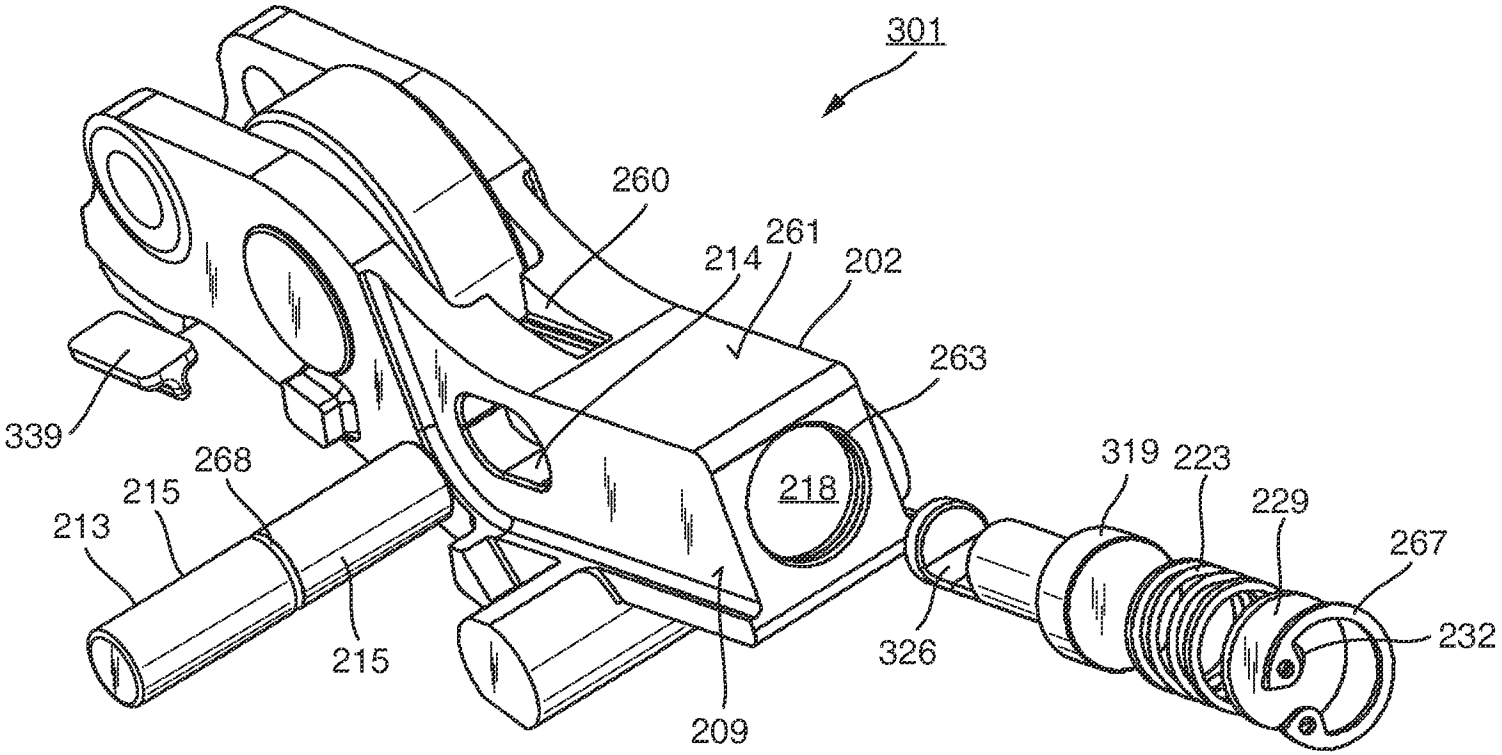
FIG. 13A shows the finger lever of FIG. 11 with its main components, in an exploded representation.
Figure 13B:
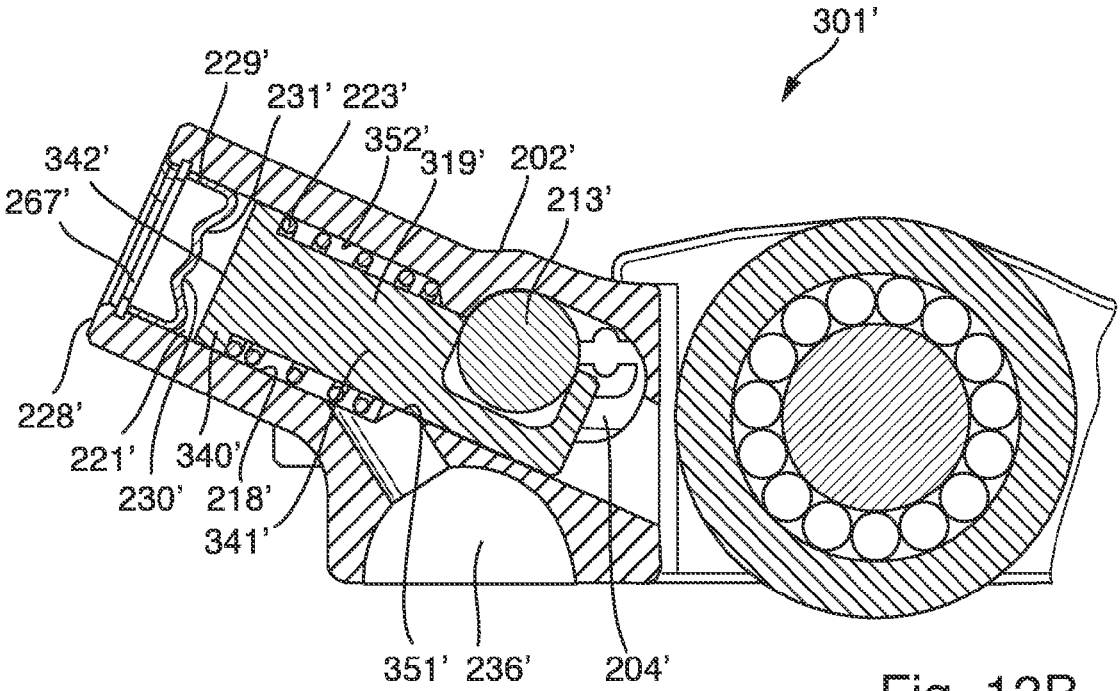
FIG. 13B shows a longitudinal section through a finger lever in a region of its coupling device, according to an example aspect of the present application.
Figure 13C:
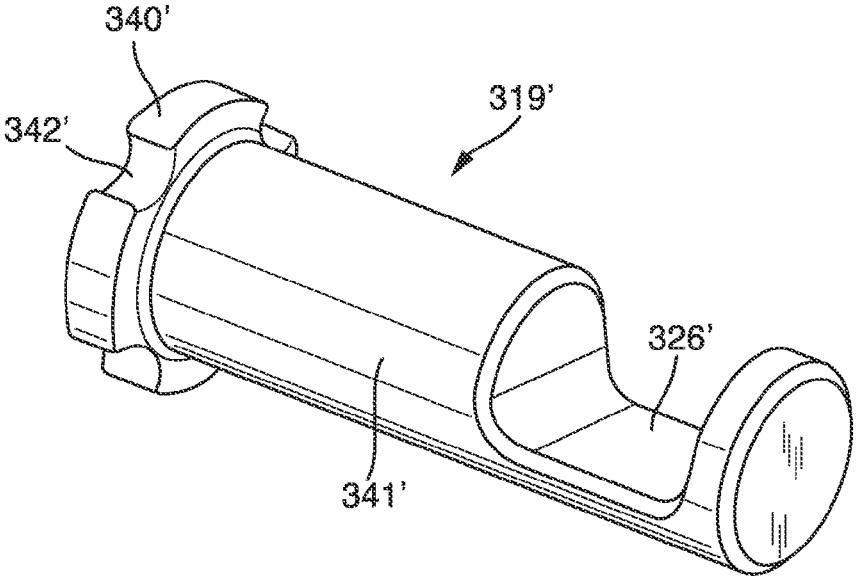
FIG. 13C shows an isometric view of an entraining piston shown in FIG. 13B, as viewed from a perspective looking towards a side and an end thereof.

Head 340' of entraining piston 319' has a different configuration to that of entraining piston 319 shown in FIG. 13A. Piston head 340' includes at least one through-opening 342' (FIG. 13C), and in the example embodiment shown in FIG. 13C, the head has a plurality of through openings 342' formed in piston head 340'. Openings 342' approximate semi-circular notches formed at the outer periphery of piston head 340'. As shown in FIG. 13C, notches 342' are circumferentially spaced approximately ninety degrees apart, although this example is non-limiting.

Hydraulic media can be operatively introduced into bore 218' via a passageway 236' below inner lever 202'. When such hydraulic media is operatively introduced into bore 218' it flows through the at least one opening 342' of piston head 340' into a pressure chamber 221' defined between piston head 340' and plug 229' and applies pressure to a plug-facing side 342' of piston head 340'. The fluid pressure on piston 319' creates a force on piston 319' opposing the force of spring 223'. When the force on piston 319' overcomes the force of spring 223', then entraining piston 319' can translate toward inner end 204'. When fluid pressure in bore 218' is operatively decreased or discontinued and the force of spring 223' on piston 319' is greater than the fluid force on piston 319', piston 319' can translate toward plug 229'.

A coupling slide 213' is entrained by entraining piston 319' and translates with entraining piston 319' to operatively engage and disengage from arms 8 (FIG. 1) in the same manner as described herein above. Owing to the arrangement of spring 223', when fluid pressure is discontinued, entraining piston 319' and entrained coupling slide 213' will move as shown in FIG. 13B towards the plug 229' in an unlocked position. To lock coupling device, fluid enters the bore 218' and through openings 342' to apply pressure to piston head 340' to move entraining piston 319' and entrained coupling slide 213' toward inner end 204' of bore 218' so that coupling slide 213' can be retained by arms 8 (FIG. 1).

Figure 14:
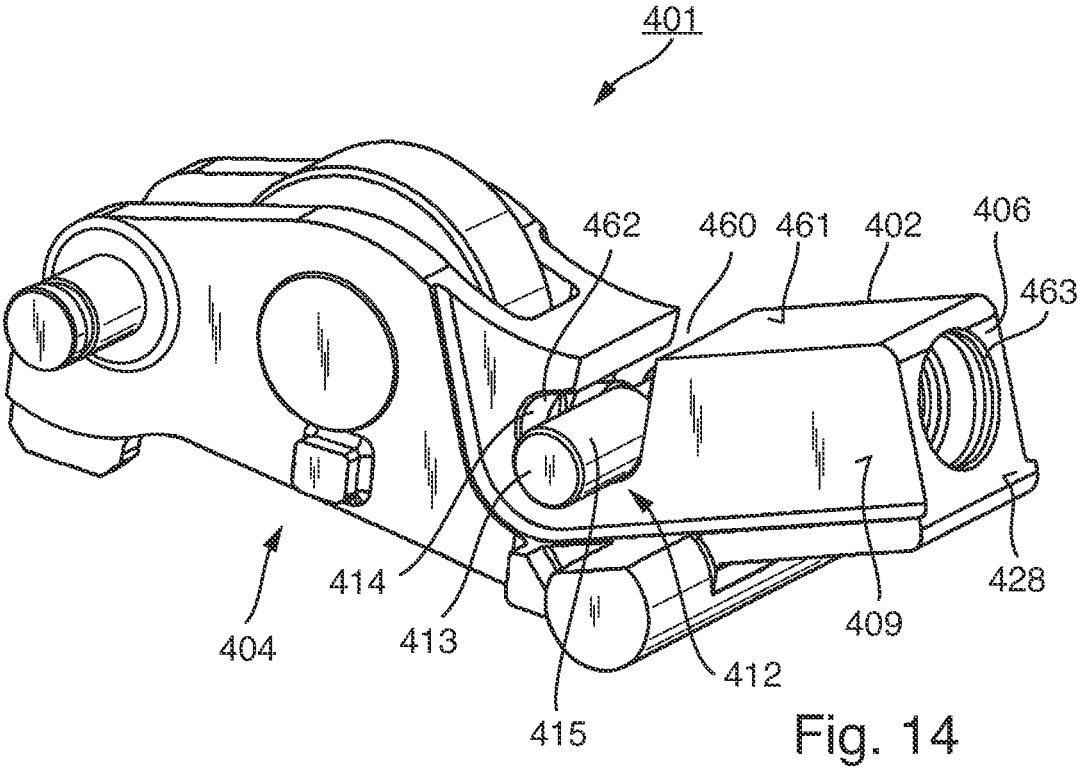
FIG. 14 shows an isometric view of another embodiment of a finger lever, according to an example aspect herein, as viewed from a perspective looking towards sides and an end thereof.

A further embodiment of a finger lever 401 will now be described with reference to FIGS. 14 to 19, according to a further aspect herein. Unless noted otherwise hereinbelow, all parts of finger lever 401 are the same as those of finger lever 1, described above. Though omitted for clarity of illustration in FIG. 14, finger lever 401 also comprises outer arms 8 and restoring spring 17 of finger lever 1. Thus, it will be understood by those of ordinary skill in the art in view hereof that FIG. 14 shows an inner lever 402 and a coupling device 412, corresponding to inner lever 2 and coupling device 12, respectively, of finger lever 1.

Inner lever 402 has a through slot 460 formed in an upper surface 461 of inner lever 402. Through slot 460 is formed generally transverse to the orientation of inner lever 402. Through slot 460 extends from upper surface 461 through inner lever 401 to aligned oblong holes 414 formed on opposite sides 409 of inner lever 402.

A coupling slide 413 extends through both oblong holes 414. Coupling slide 413 is supported by surfaces 462 that define oblong holes 414. Coupling slide 413 is constructed to roll along surfaces 462 in oblong holes 414 during operation, as described below. FIG. 14 shows coupling device 412 in a coupled state, so that a lift of the high lift cams in contact with outer arms 8 (not shown in FIGS. 14-19, as discussed above, but shown in FIG. 1) is transmitted to the gas exchange valve.

Figure 16:
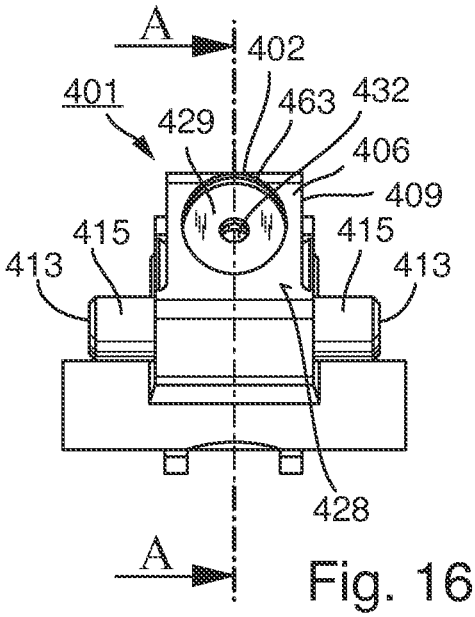
FIG. 16 shows an elevation view of the finger lever of FIG. 14, as viewed from a perspective looking towards an end thereof.

FIG. 16 shows a view of finger lever 401 from an outer end 406 of inner lever 402. End portions 415 of coupling slide 413 protrude axially outwardly from outer sides 409 of inner lever 402, shown in FIG. 16. Also shown in FIG. 16 is an opening 463 formed in outer end 406, which is partially closed by plug 429, which has an aperture 432 formed therein. Surrounding opening 463 is an end surface 428. Aperture 432 permits gas exchange therethrough.

Figure 17:
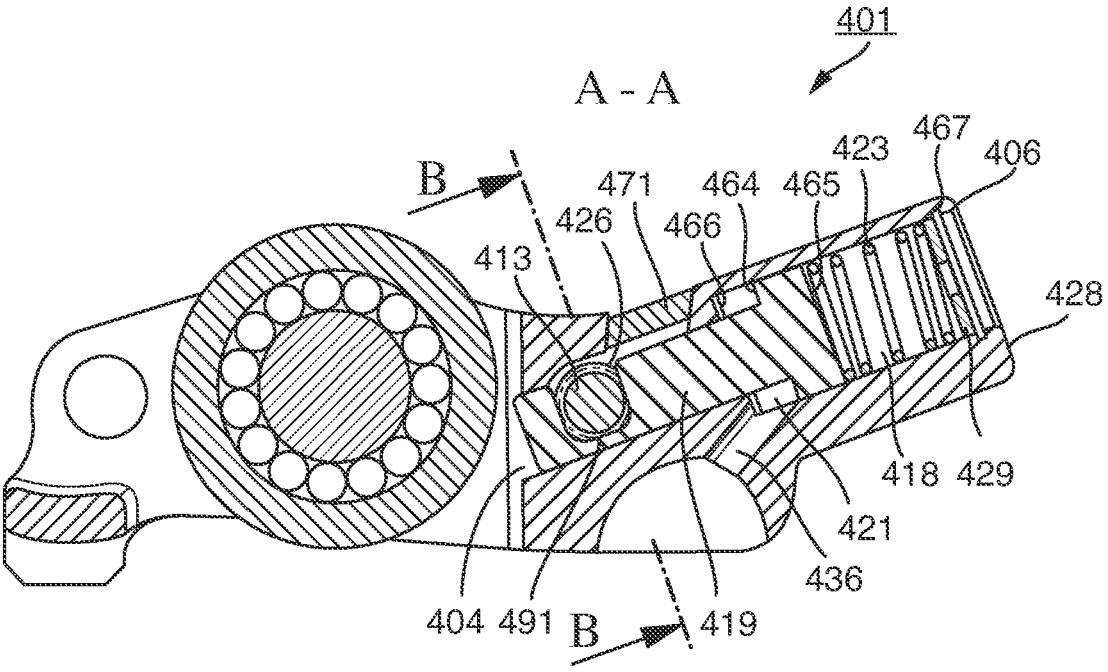
FIG. 17 is a section view of the finger lever of FIG. 14, taken along section line A-A of FIG. 16.

FIG. 17 shows a view of finger lever 401 taken along section line A-A in FIG. 16. Longitudinal bore 418 (FIG. 17) extends from end surface 428 to inner end 404. An entraining piston 419 is received in longitudinal bore 418 for longitudinal displacement. Entraining piston 419 has a face 465 which is contacted by a spring 423. Spring 423 biases entraining piston 419 towards inner end 404. A pressure chamber 421 is defined between a back side 464 of face 465 of entraining piston 419 and a flange 466 formed along bore 418. Bore 418 is closed at its inner end 404. At outer end 463 of bore 418, plug 429 is retained by a snap ring 467. Coupling slide 413 is entrained in an incision 426 formed in entraining piston 419, described further hereinbelow.

Figure 15:
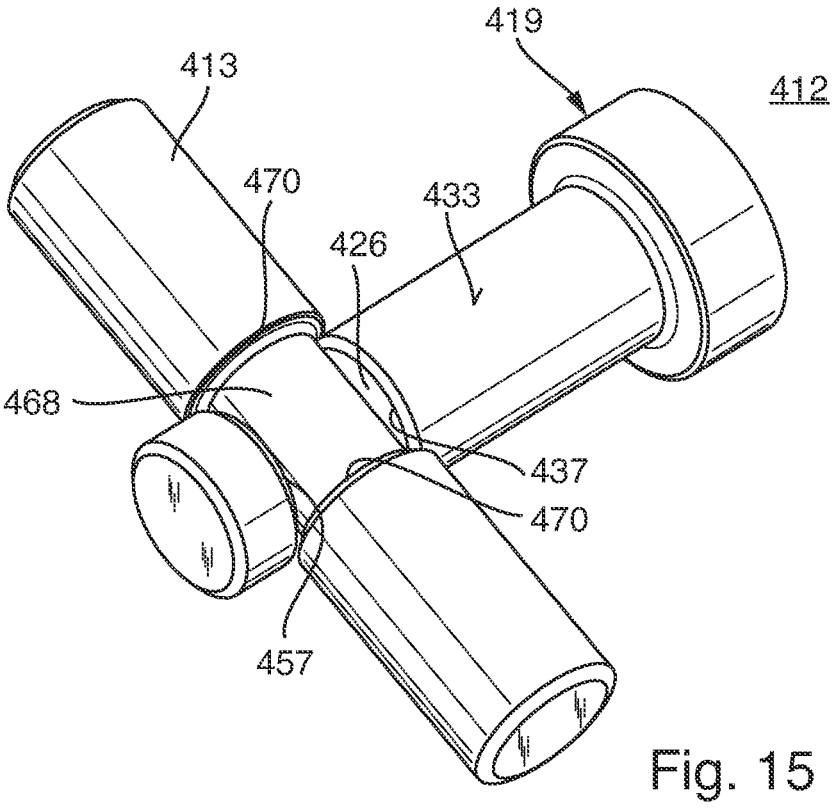
FIG. 15 shows an isometric view of an arrangement of a coupling slide and an entraining piston of the finger lever of FIG. 14.
Figure 18:
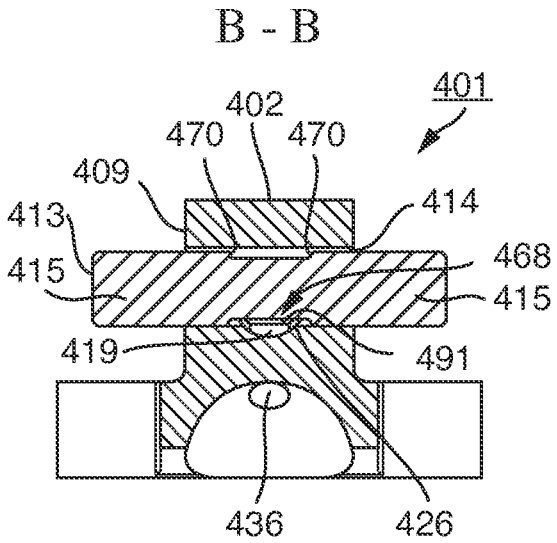
FIG. 18 is a section view of the finger lever of FIG. 14, taken along section line B-B of FIG. 17.

A description of coupling slide 413 and entraining piston 419, which form coupling device 412, will now be provided with reference to FIGS. 15 and 18, the latter of which shows finger lever 401 taken along line B-B of FIG. 17. An upper side 433 (FIG. 15) of entraining piston 419 comprises a crosswise extending incision 426 in which coupling slide 413 can be seated, while being supported on at least one of side walls 437 of incision 426.

Coupling slide 413 has an annular groove 468 formed substantially centrally in the outer surface of coupling slide 413. Width 490 (FIG. 19) of groove 468 is slightly wider than the width of base 491 (FIG. 19) of incision 426 in entraining piston 419. As shown in FIG. 18 annular groove 468 straddles base 491 and base 491 extends radially into annular groove 468. Annular groove 468 has a depth such that base 491 of incision 426 is spaced from, and does not contact, the oppositely facing portion of the annular groove 468. Such spacing of base 491 from groove 468 reduces contact therebetween and promotes rotation of coupling slide 413 as it is displaced by entraining piston 419.

Figure 19:
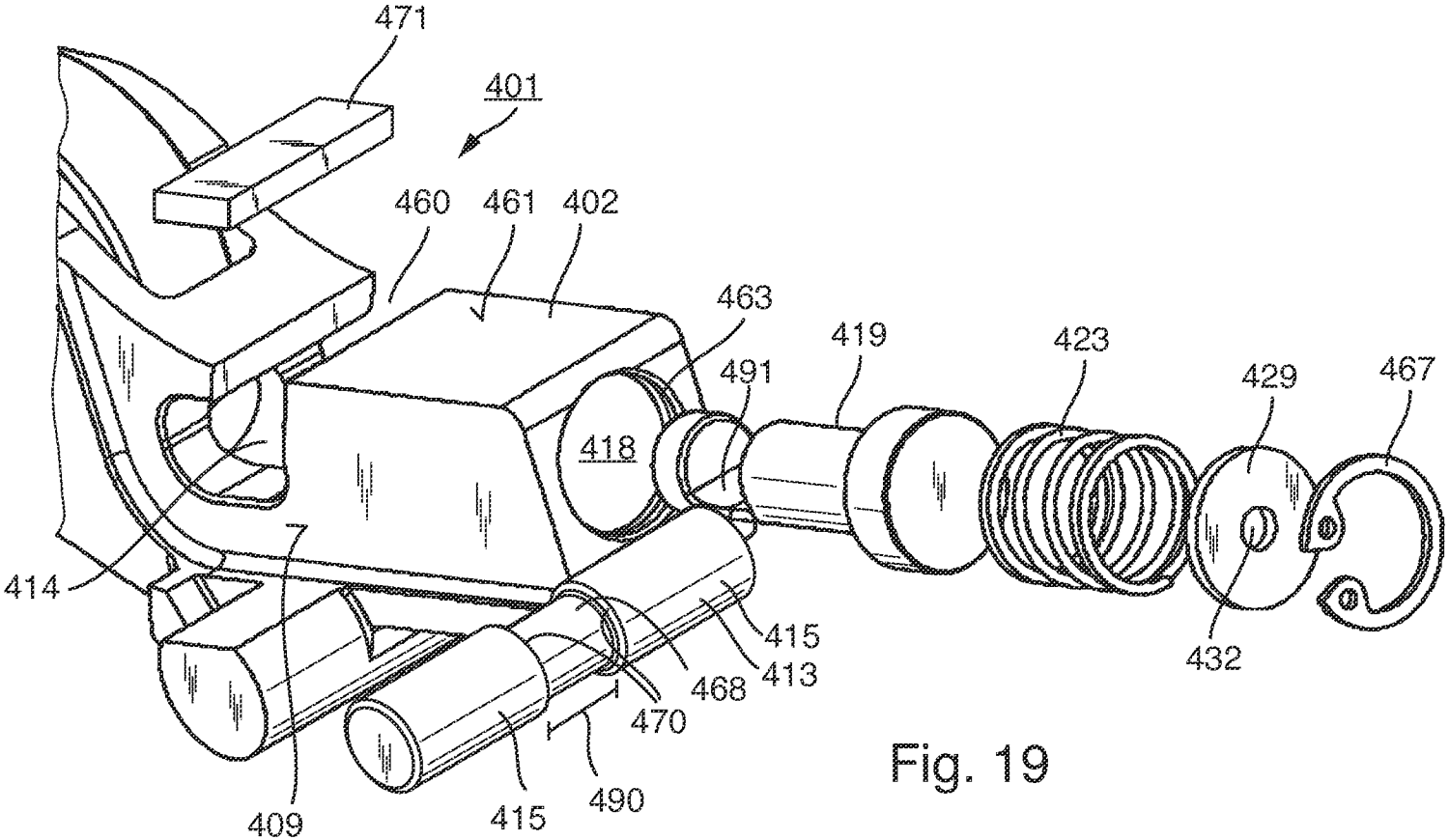
FIG. 19 shows the finger lever of FIG. 14 with its main components, in an exploded representation.

Axial retention of coupling slide 413 is realized as a result of interference between side walls 470 (FIGS. 18 and 19) of annular groove 468 and entraining piston 419. As shown in FIG. 18, annular groove 468 is aligned with incision 426 to facilitate assembly of coupling slide 413 and entraining piston 419 with inner lever 402. During assembly, slot 460 (FIGS. 14 and 19) is aligned with incision 426 formed in entraining piston 419. Coupling slide 413 is oriented transverse to the direction of inner lever 402, as shown in FIG. 19, and coupling slide 413 is introduced into slot 460 and seated over base 491 of incision 426. A cover 471 can be placed over slot 460 in inner lever 402. Cover 471 prevents coupling slide 413 from being displaced from bore 418 when coupling device 412 is in an uncoupled state. Cover 471 can be retained by various connection techniques, including, for example, a press fit connection, snap fit connection, slotted connection, and a welded connection, or via another suitable connection mechanism.

When assembled together as shown in FIG. 15, coupling slide 413 is axially retained with respect to entraining piston 419 by interference between side walls 470 of annular groove 468 of coupling slide 413 and base 491 of incision 426 of entraining piston 419. Moreover, when coupling slide 413 is assembled into coupling device 412, rotation of coupling slide 413 is substantially not limited. One benefit of the arrangement between coupling slide 413 and entraining piston 419 is that externally assembled snap rings 39 of finger lever 1 need not be employed.

Coupling device 412 is shown in a coupled state in FIG. 17. A hydraulic medium can be operatively introduced to pressure chamber 421 to place coupling device 412 in a decoupled state. The hydraulic medium can be introduced into pressure chamber 421 through a longitudinal channel 436 (FIG. 17) located at an underside of entraining piston 419. Such hydraulic medium is operatively introduced or removed from pressure chamber 421 to longitudinally displace coupling slide 419 in bore 418, which thereby moves entrained coupling slide 413 longitudinally in oblong holes 414. Also, hydraulic medium is operatively permitted to be released from pressure chamber 421 to return coupling device 412 to the coupled state.

A displacement of entraining piston 419 and coupling slide 413 into a coupled position is realized through the urging force of compression spring 423, which urges piston 419 toward inner end 404 of bore 418. It will be appreciated by those of ordinary skill in the art in view of this description that the arrangement of entraining piston 419 and spring 423 can be longitudinally reversed like that shown in FIG. 3 such that a displacement of entraining piston 419 into a coupled position would be realized through introduction of hydraulic medium to apply force to compress compression spring 423 toward inner end 404.

To obtain a low valve lift on the gas exchange valve, hydraulic medium pressure in pressure chamber 421 is increased to obtain the uncoupled state of coupling device 412. During the cam base circle phase pressure chamber 421 is pressurized by hydraulic medium supplied via longitudinal channel 436. Entraining piston 419 is displaced against the force of its compression spring 423 towards outer end 406. During this displacement, entraining piston 419 displaces coupling slide 413 with which piston 419 is connected. During this displacement, both end portions 415 of coupling slide 413 come out of contact from outer arms 8 (not shown in FIGS. 14-19, as discussed above, but shown in FIG. 1). During a subsequent cam lift, outer arms 8 (not shown in FIGS. 14-19, as discussed above, but shown in FIG. 1) pivot "in idle" relative to inner lever 402, so that inner lever 402 executes a pivoting movement in accordance with its activating low lift cam.

To obtain a high valve lift on the gas exchange valve, hydraulic medium pressure in pressure chamber 421 (FIG. 17) is substantially reduced during the cam base circle phase, so that entraining piston 419 together with its coupling slide 413 is displaced towards inner end 404 through the urging force of spring 423. When coupling slide 413 has reached its final position, it engages through both of its end portions 415 with slight coupling lash under entraining surfaces 16 (not shown in FIGS. 14-19, as discussed above, but shown in FIG. 1) of outer arms 8 (not shown in FIGS. 14-19, as discussed above, but shown in FIG. 1). In the coupled state, during a subsequent cam lift, finger lever 401 follows the lift of the high lift cams.

Figure 20:
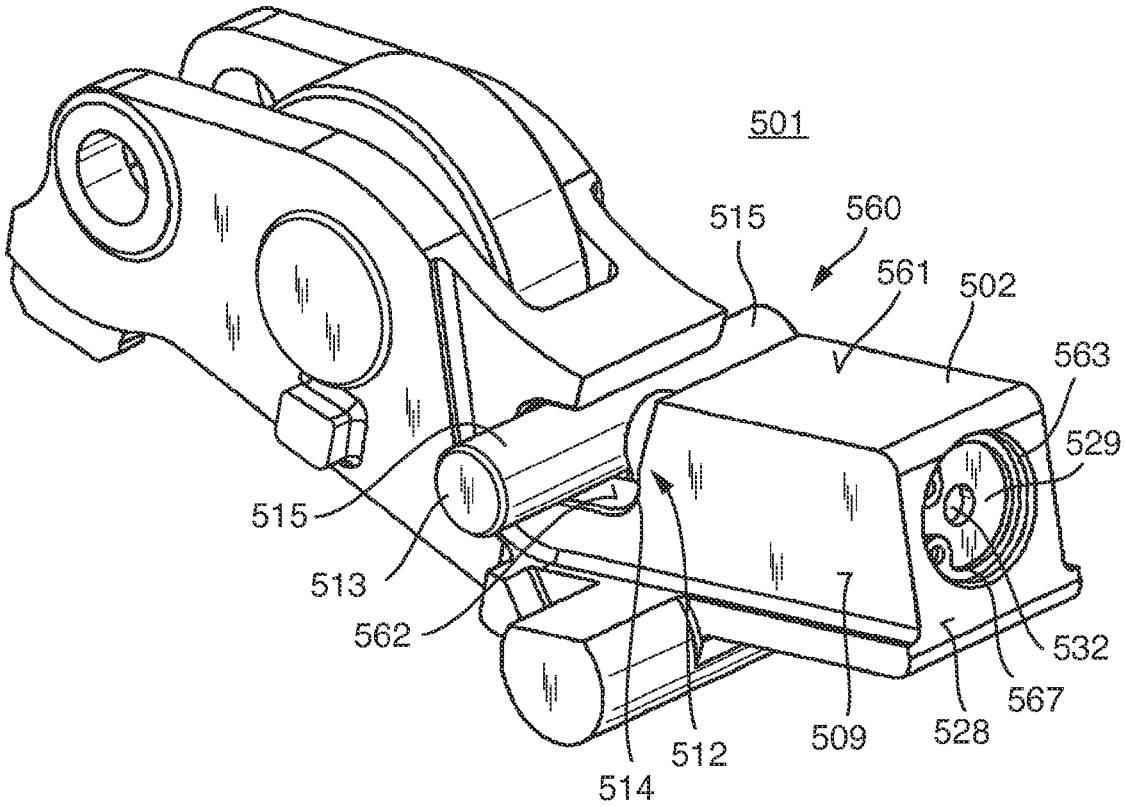
FIG. 20 shows an isometric view of another embodiment of the finger lever, according to an example aspect herein, as viewed from a perspective looking towards a side and ends thereof.

A finger lever 501 will now be described with reference to FIGS. 20 to 26, according to a further example embodiment herein. Unless noted otherwise hereinbelow, all parts of finger lever 501 are the same as those of finger lever 1, described above. Though omitted for clarity of illustration in FIG. 20, finger lever 501 also comprises outer arms 8 and restoring spring 17 of finger lever 1. Thus, it will be understood by those of ordinary skill in the art in view of this description that FIG. 20 shows an inner lever 502 and a coupling device 512, corresponding to inner lever 2 and coupling device 12, respectively, of finger lever 1.

Inner lever 502 has a through slot 560 formed along an upper surface 561 of inner lever 502. The through slot 560 is formed generally transverse to the orientation of inner lever 502. The through slot 560 extends from upper surface 561 through inner lever 501 to oblong holes 514, which are formed in side walls 509 of inner lever 501. Oblong holes 514 are aligned directly opposite from one another. While through slot 560 is shown in FIG. 20 as being uncovered, it will be understood that in its fully assembled state, shown in FIG. 24, through slot 560 can be covered by cover 571.

A coupling slide 513 extends through both oblong holes 514. Coupling slide 513 is supported by surfaces 562 of inner lever 502 that define oblong holes 514. Coupling slide 513 is constructed to slide along surfaces 562 in oblong holes 514 when coupling slide 513 is displaced, as described below. FIG. 20 shows coupling device 512 in a coupled state, so that a lift of the high lift cams in contact with outer arms 8 (not shown in FIGS. 20-26, as discussed above, but shown in FIG. 1) is transmitted to the gas exchange valve.

Figure 23:
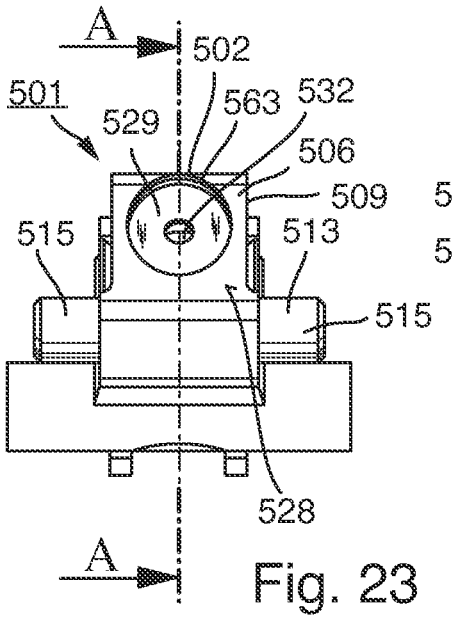
FIG. 23 shows an elevation view of the finger lever of FIG. 20, as viewed from a perspective looking at an end thereof.

FIG. 23 shows a view of finger lever 501 from an outer end 506 of inner lever 502. End portions 515 of coupling slide 513 protrude axially outwardly from outer sides 509 of inner lever 502. Also shown in FIG. 23 is an opening 563 formed in outer end 506 which is at least partially closed by plug 529, which has an aperture 532 formed therein. Surrounding opening 563 is an end surface 528. Aperture 532 permits gas exchange therethrough.

Figure 24:
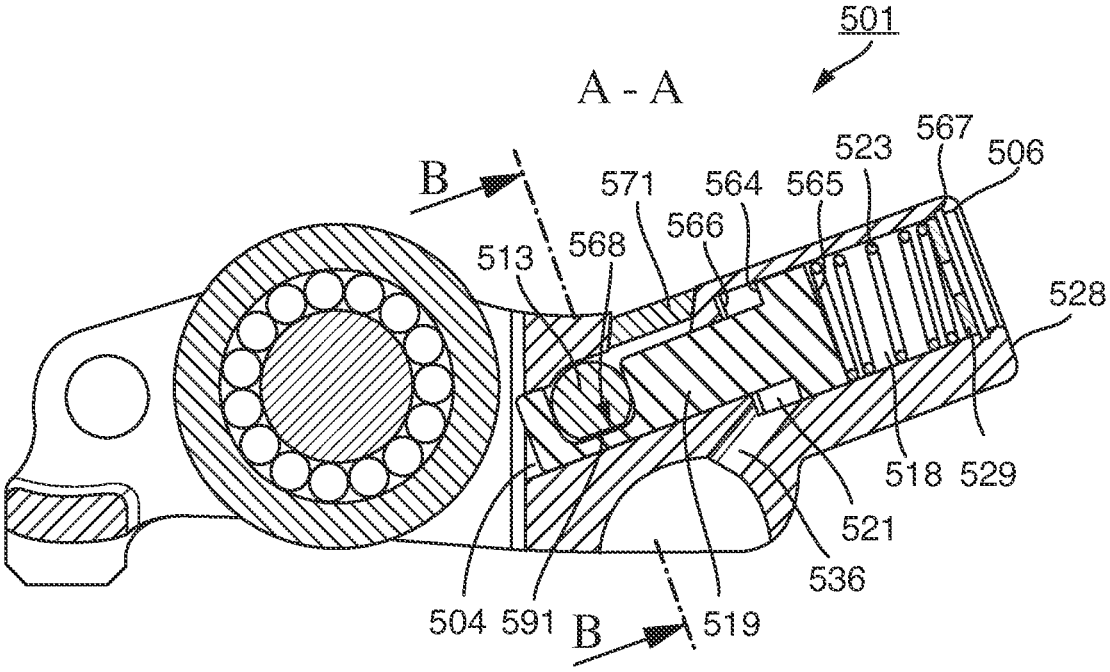
FIG. 24 is a section view of the finger lever of FIGS. 20 and 23, taken along section line A-A of FIG. 23.
Figure 26:
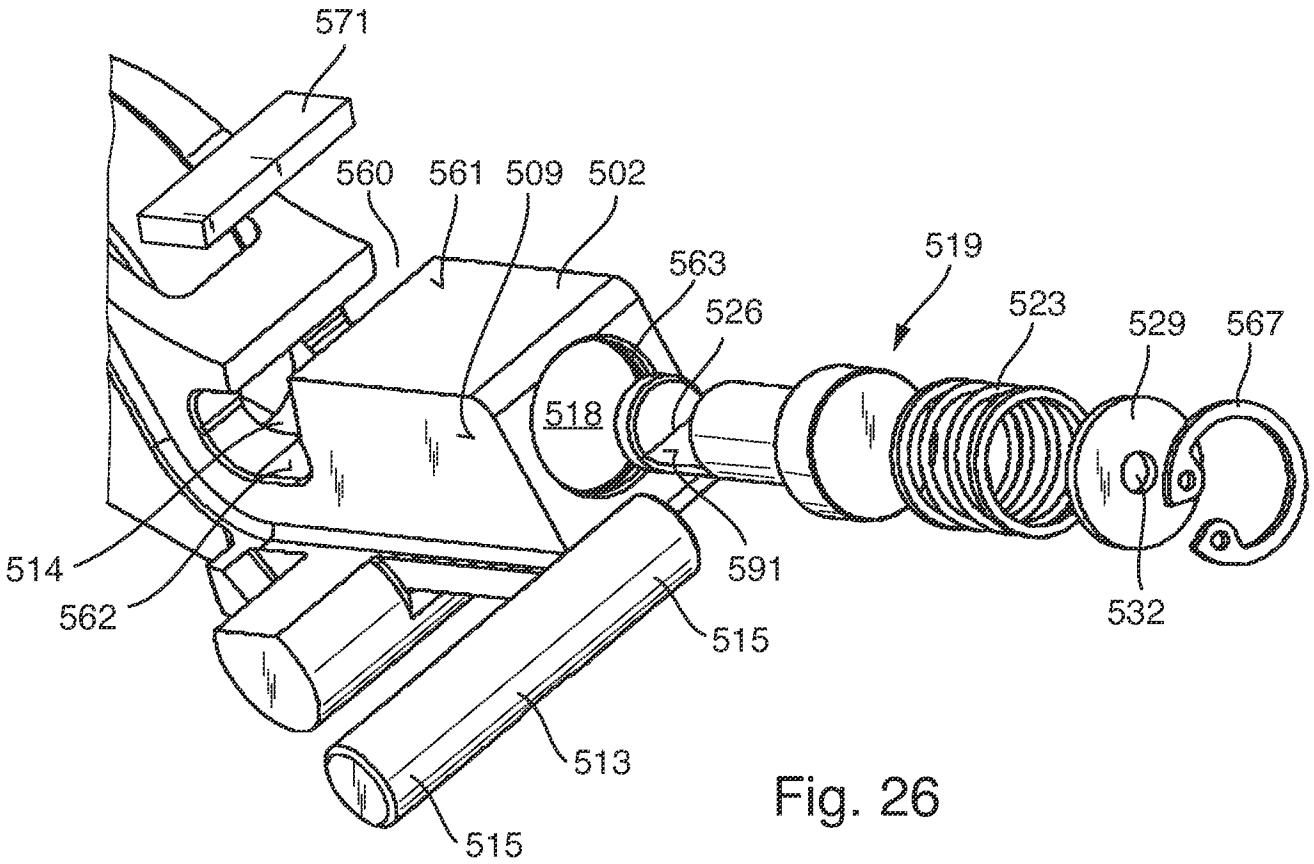
FIG. 26 shows the finger lever of FIG. 20 with its main components, in an exploded representation.

FIG. 24 shows a view of coupling device 512 taken along section line A-A in FIG. 23. Longitudinal bore 518 extends from end surface 528 to inner end 504. An entraining piston 519 is received in longitudinal bore 518 for longitudinal displacement. Entraining piston 519 has a face 565, which is biased by spring 523. Spring 523 urges entraining piston 519 towards inner end 504. A pressure chamber 521 is defined between a back side 564 of face 565 of entraining piston 519 and a flange 566 formed in bore 518. Bore 518 is closed at its inner end 504. At outer end 563 of bore 518, plug 529 is retained by a snap ring 567. Coupling slide 513 is entrained in an incision 526 (FIG. 26) formed in entraining piston 519, described further hereinbelow.

Figure 21:
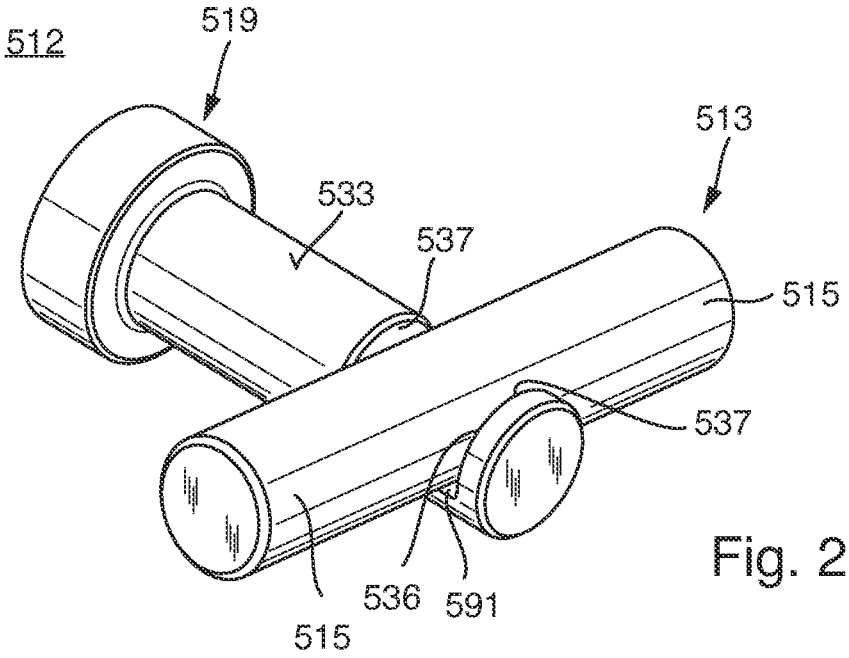
FIG. 21 shows an isometric view of an arrangement of a coupling slide and an entraining piston of the finger lever of FIG. 20, as viewed from a perspective looking down on an upper part, a side, and an end thereof.
Figure 22:
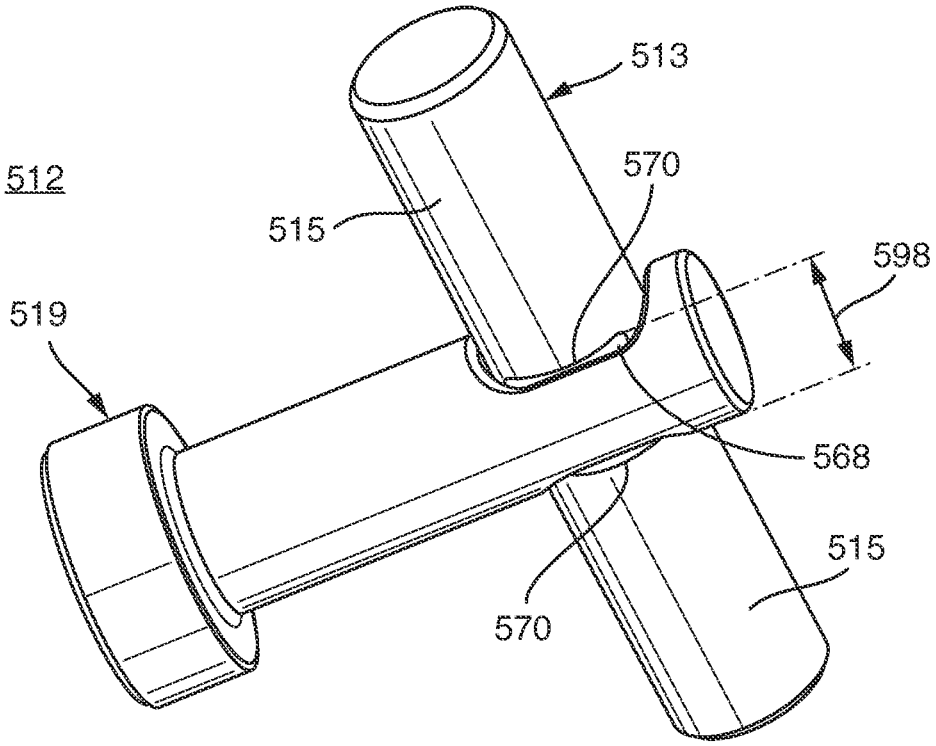
FIG. 22 shows an isometric view of an arrangement of the coupling slide and the entraining piston of the finger lever of FIG. 20, as viewed from a perspective looking up towards the arrangement.
Figure 25:
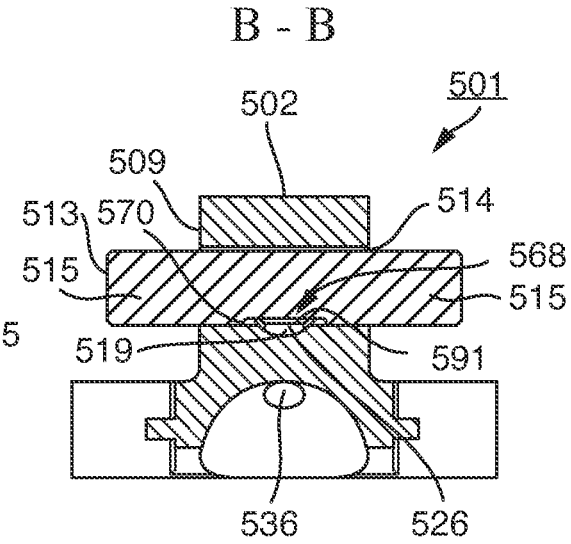
FIG. 25 is a section view of the finger lever of FIGS. 20 and 24, taken along section line B-B of FIG. 24.

A description of coupling slide 513 and entraining piston 519 will now be provided with reference to FIGS. 21, 22, and 25, the latter of which shows finger lever 501 taken along line B-B of FIG. 24. An upper side 533 of entraining piston 519 comprises a crosswise extending incision 526 in which coupling slide 513 can be seated. While seated, coupling slide 513 is also supported by at least one of side walls 537 of incision 526.

Coupling slide 513 has a groove 568 formed substantially centrally on its underside, as best seen in FIG. 22. Groove 568 extends transverse to the direction in which the coupling slide 513 extends and the groove 568 has oppositely facing side walls 570 (FIG. 25). A transverse width 590 (FIG. 22) of groove 568 is slightly larger than the width of base 591 (FIG. 26) of incision 526 (FIG. 26) in entraining piston 519. As shown in FIG. 25, transverse groove 568 straddles base 591 of incision 526. In the position shown in FIG. 25, base 591 of incision 526 extends radially into groove 568. However, in one example groove 568 has a depth such that base 591 of incision 526 is spaced from, and does not contact, the oppositely facing portion of groove 568.

Axial retention of coupling slide 513 is realized as a result of interference between side walls 570 (FIG. 25) of groove 568 formed in coupling slide 513 and entraining piston 519. As shown in FIG. 25, groove 568 is aligned with incision 526 to facilitate assembly of coupling slide 513 and entraining piston 519 together in inner lever 502.

During assembly, entraining piston 519 is positioned in longitudinal bore 518 so that incision 526 is vertically aligned with through slot 560 in inner lever 502. Coupling slide 513 is inserted into through slot 560 such that groove 568 in coupling slide 513 is received into and nests with incision 526. Cover 571, mentioned above, is placed over through slot 560. Cover 571 prevents coupling slide 513 from being displaced from longitudinal bore 518 when coupling device 512 is in an uncoupled state. Cover 571 can be retained by various connection techniques, including, for example, a press fit connection, snap fit connection, slotted connection, and welded connection, or via another connection mechanism.

When assembled together as shown in FIGS. 21 and 22, coupling slide 513 is axially retained with respect to entraining piston 519 by interference between side walls 570 of groove 568 of coupling slide 513 and base 591 of incision 526 of entraining piston 519. One benefit of the arrangement between coupling slide 513 and entraining piston 519 is that the arrangement of externally assembled snap rings 39 of finger lever 1 need not be employed. However, when coupling slide 513 is assembled into coupling device 512, rotation of coupling slide 513 is substantially limited.

Due to the inability or limited ability of coupling slide 513 to rotate, wear and fatigue may occur in certain areas of coupling slide 513. To address such wear and fatigue concerns, the embodiments described above (other than FIGS. 20-26) permit their coupling slides to rotate, while also eliminating retaining elements 39 of the embodiment of lever 1 shown in FIG. 3.

A hydraulic medium can be introduced into pressure chamber 521 through a longitudinal channel 536 located on an underside of entraining piston 519. Such hydraulic medium is operatively introduced or removed from pressure chamber 521 to longitudinally displace coupling slide 519 in bore 518, which thereby moves entrained coupling slide 513 in oblong holes 514.

Coupling device 512, comprised of coupling slide 513 and entraining piston 519, is shown in a coupled state in FIG. 24. Hydraulic medium can be operatively introduced to pressure chamber 521 to place coupling device 512 in a decoupled state. Also, hydraulic medium is operatively permitted to be released from pressure chamber 512 to return coupling device 512 to the coupled state.

A displacement of entraining piston 519 into a coupled position is realized through the urging force of compression spring 523, which urges piston 519 toward inner end 504 of bore 518. It will be appreciated by those of ordinary skill in the art in view hereof that the arrangement of entraining piston 519 and spring 523 can be longitudinally reversed like that shown in FIG. 3 such that a displacement of entraining piston 519 into a coupled position would be realized through introduction of hydraulic medium to apply force to compress compression spring 523 toward inner end 504.

To obtain a low valve lift on the gas exchange valve, hydraulic medium pressure in pressure chamber 521 is increased to obtain the uncoupled state of coupling device 512. During the cam base circle phase pressure chamber 521 is pressurized by hydraulic medium via longitudinal channel 536. Entraining piston 519 is displaced against the force of compression spring 523 towards outer end 506. During this displacement, entraining piston 519 displaces coupling slide 513 with which it is connected, and both end portions 515 of coupling slide 513 come out of contact from outer arms 8 (not shown in FIGS. 20-26, as discussed above, but shown in FIG. 1). During a subsequent cam lift, outer arms 8 (not shown in FIGS. 20-26, as discussed above, but shown in FIG. 1) pivot "in idle" relative to inner lever 502, so that inner lever 502 executes a pivoting movement in accordance with its activating low lift cam.

To obtain a high valve lift on the gas exchange valve, hydraulic medium pressure in pressure chamber 521 is substantially reduced during the cam base circle phase, so that entraining piston 519, together with coupling slide 513, are displaced towards end 504 through the force of compression spring 523. When coupling slide 513 has reached its final position, it engages through both of its end portions 515 with slight coupling lash under entraining surfaces 16 (not shown in FIGS. 20-26, as discussed above, but shown in FIG. 1) of outer arms 8 (not shown in FIGS. 20-26, as discussed above, but shown in FIG. 1). In the coupled state, during a subsequent cam lift, finger lever 501 follows the lift of the high lift cams.

Example aspects herein have been particularly shown and described with respect to exemplary embodiments. However, it will be understood by those skilled in the art that changes in form and details may be made therein without departing from the scope and spirit of the invention.

What is claimed is:

1. A finger lever for a valve train of an internal combustion engine, the finger lever comprising:

an inner lever having a longitudinal bore;

at least one arm pivotally coupled to the inner lever; and a coupling device operatively displaceable to control movement of the at least one arm relative to the inner lever, wherein the coupling device comprises a slide and a piston, the slide and piston being coupled together within the inner lever, wherein the piston includes a head and a stem extending from the head to the slide, wherein the piston is received in the longitudinal bore, wherein the head of the piston has an outer circumferential surface that has at least one aperture formed therein, wherein the piston and slide are interlocked and the slide has a groove formed therein, wherein the piston has an incision formed therein, wherein the groove of the slide is received in the incision to interlock the piston with the slide, wherein the coupling device further comprises a locking member constructed to interlock the piston and the slide, and wherein the locking member is disposed at least partially within the inner lever.

2. The finger lever of claim 1, wherein the groove is at least one of an annular groove and a groove formed on an outer periphery of the slide.

3. The finger lever according to claim 1, wherein the locking member is formed as a ring.

4. The finger lever according to claim 1, wherein the groove formed in the slide is constructed to receive the locking member.

5. The finger lever according to claim 1, wherein the locking member is constructed to be attached to at least one of the slide and the piston.

6. The finger lever according to claim 1, wherein the inner lever has a longitudinal bore formed therein, wherein the piston is disposed in the longitudinal bore, the piston having an entraining slot in which at least part of the slide is received.

7. The finger lever according to claim 6, further comprising at least one biasing member arranged to bias the piston relative to the inner lever.

8. The finger lever according to claim 6, wherein the slide is constructed to be displaced in a coupled position or an uncoupled position, wherein in the coupled position the slide is entrained by the at least one arm, and in the uncoupled position the slide is not entrained by the at least one arm.

9. The finger lever according to claim 8, wherein when the slide is in the coupled position, the at least one arm is not permitted to pivot relative to the inner lever, and in the uncoupled position, the at least one arm is permitted to pivot relative to the inner lever.

10. The finger lever according to claim 9, wherein the slide extends through at least one outer wall of the inner lever in a first direction transverse to the longitudinal bore.

11. The finger lever according to claim 8, wherein the biasing member disposed around the stem of the piston and between the piston head and the longitudinal bore of the inner lever.

12. The finger lever according to claim 1, wherein the locking member is disposed within the inner lever.

13. A finger lever for a valve train of an internal combustion engine, the finger lever comprising:

an inner lever having a longitudinal bore extending from a first, inner end of the inner lever to a second, front end of the inner lever opposite and distal to the first, inner end;

at least one arm pivotally coupled to the inner lever proximate to the first, inner end of the inner lever; and a coupling device operatively displaceable to control movement of the at least one arm relative to the inner lever, wherein the coupling device comprises a slide, a piston, and a biasing member, the slide and piston being coupled together within the inner lever, wherein the piston includes a head and a stem extending from a first side of the head to the slide and wherein the biasing member is disposed in the longitudinal bore between the second, front end of the inner lever and a second side of the head opposite the first side of the head.

14. The finger lever of claim 13, wherein the piston and slide are interlocked and the slide has a groove formed therein.

15. The finger lever of claim 14, wherein the piston has an incision formed therein and wherein the groove of the slide is received in the incision to interlock the piston with the slide.

16. The finger lever of claim 14, wherein the groove is at least one of an annular groove and a groove formed on an outer periphery of the slide.

17. The finger lever according to claim 14, wherein the coupling device further includes a locking member constructed to interlock the piston and the slide.

18. The finger lever according to claim 17, wherein the locking member is disposed at least partially within the inner lever.

19. The finger lever according to claim 17, wherein the locking member is formed as a ring.

20. The finger lever according to claim 17, wherein the groove formed in the slide is constructed to receive the locking member.

21. The finger lever according to claim 17, wherein the locking member is constructed to be attached to at least one of the slide and the piston.

22. The finger lever according to claim 13, wherein the piston has an entraining slot in which at least part of the slide is received.

23. The finger lever according to claim 22, wherein the biasing member is arranged to bias the piston relative to the inner lever.

24. The finger lever according to claim 22, wherein the slide is constructed to be displaced in a coupled position or an uncoupled position, wherein in the coupled position the slide is entrained by the at least one arm, and in the uncoupled position the slide is not entrained by the at least one arm.

25. The finger lever according to claim 24, wherein when the slide is in the coupled position, the at least one arm is not permitted to pivot relative to the inner lever, and in the uncoupled position, the at least one arm is permitted to pivot relative to the inner lever.

26. The finger lever according to claim 25, wherein the slide extends through at least one outer wall of the inner lever in a first direction transverse to the longitudinal bore.

* * * * *